US012669124B2

(12) United States Patent
Koci et al.

(10) Patent No.: US 12,669,124 B2
(45) Date of Patent: Jun. 30, 2026

(54) PUMP AND METHOD OF MANUFACTURING A SEALING

(71) Applicant: Pfeiffer Vacuum Technology AG, Asslar (DE)

(72) Inventors: Bernd Koci, Schoeffengrund (DE); Jonas Becker, Bischoffen (DE); Sebastian Latta, Wetzlar (DE)

(73) Assignee: Pfeiffer Vacuum Technology AG, Asslar (DE)

( * ) Notice: Subject to any disclaimer, the term of this patent is extended or adjusted under 35 U.S.C. 154(b) by 0 days.

(21) Appl. No.: 18/512,142

(22) Filed: Nov. 17, 2023

(65) Prior Publication Data

US 2024/0209857 A1 Jun. 27, 2024

(30) Foreign Application Priority Data

Dec. 21, 2022 (EP) ..... 22215608

(51) Int. Cl.

| | |
|---|---|
| ***F04C 29/02*** | (2006.01) |
| ***F04C 25/02*** | (2006.01) |
| ***F04C 27/00*** | (2006.01) |
| ***F04D 29/02*** | (2006.01) |
| ***F04D 29/28*** | (2006.01) |
| *F04D 29/08* | (2006.01) |

(52) U.S. Cl.

CPC ..... *F04C 25/02* (2013.01); *F04C 27/00* (2013.01); *F04D 29/02* (2013.01); *F04D 29/026* (2013.01); *F04D 29/284* (2013.01); *F04C 2220/10* (2013.01); *F04C 2230/91* (2013.01); *F04D 29/083* (2013.01)

(58) Field of Classification Search

CPC ..... F04C 27/00; F04C 29/02; F04C 29/026; F04C 29/284

USPC ..... 427/523, 385.5, 409, 525

See application file for complete search history.

(56) References Cited

U.S. PATENT DOCUMENTS

2006/0016690 A1* 1/2006 Ostrovsky ..... C25D 11/024 205/104
2007/0267299 A1 11/2007 Mitani
2009/0068451 A1 3/2009 Froitzheim et al.

FOREIGN PATENT DOCUMENTS

CN 104911674 A * 9/2015 ..... C25D 11/26
CN 209039570 U * 6/2019 ..... C23C 14/06
CN 214533534 U 10/2021
DE 1 646 050 A1 8/1971
EP 0 280 264 A2 8/1988

(Continued)

OTHER PUBLICATIONS

English EP1832753 by PE2E Feb. 7, 2025.*

(Continued)

*Primary Examiner* — Deming Wan

(74) *Attorney, Agent, or Firm* — Oblon, McClelland, Maier & Neustadt, L.L.P.

(57) ABSTRACT

The present invention relates to a pump, in particular a vacuum pump, comprising a pump-active component having a coating, wherein the coating comprises an oxide layer, which is in particular formed by anodic oxidation in an acidic electrolyte and which has pores, and a fluorine-free polymer-based and/or sol-gel-based sealing, and wherein the pores of the oxide layer are at least partly covered by the sealing and/or impregnated with the sealing and/or filled with the sealing. The present invention further relates to a method of sealing a porous oxide layer.

21 Claims, 17 Drawing Sheets

(56) References Cited

FOREIGN PATENT DOCUMENTS

| | | | | |
|---|---|---|---|---|
| EP | 1832753 | A2 * | 9/2007 | ..... C25D 11/02 |
| EP | 3 153 706 | A1 | 4/2017 | |
| EP | 3 940 234 | A2 | 1/2022 | |
| FR | 3110605 | A1 * | 11/2021 | ..... C25D 17/10 |
| GB | 433367 | A | 8/1935 | |
| GB | 2594314 | A | 10/2021 | |
| JP | 60-22092 | A | 2/1985 | |
| JP | 61-25983 | A | 2/1986 | |
| JP | 2-158336 | A | 6/1990 | |
| JP | 2006-257908 | A | 9/2006 | |
| WO | WO 03/056187 | A1 | 7/2003 | |

OTHER PUBLICATIONS

English FR3110605 by PE2E Feb. 7, 2025.*
English CN 209039570 by PE2E Feb. 7, 2025.*
English translation of CN104911674 by PE2E, Sep. 5, 2025.*
Extended European Search Report issued Jun. 16, 2023, in corresponding European Patent Application No. 22215608.5, 9 pages.
M. Takaya et al: "Novel tribological properties of anodic oxide coating of aluminum impregnated with iodine compound", Surface and Coatings Technology, Bd. 169-170, Nr. 170, Jun. 1, 2003, Seiten 160-162, XP055637529, ISSN: 0257-8972, DOI:10.1016/S0257-8972(03)00218-4.
Japanese Office Action issued May 29, 2025 in Japanese Patent Application No. 2023-189799 (with German Translation), 11 pages.
European Notice of Opposition dated Dec. 22, 2025, in corresponding European Patent Application No. 22215608.5, 17 pages.

* cited by examiner

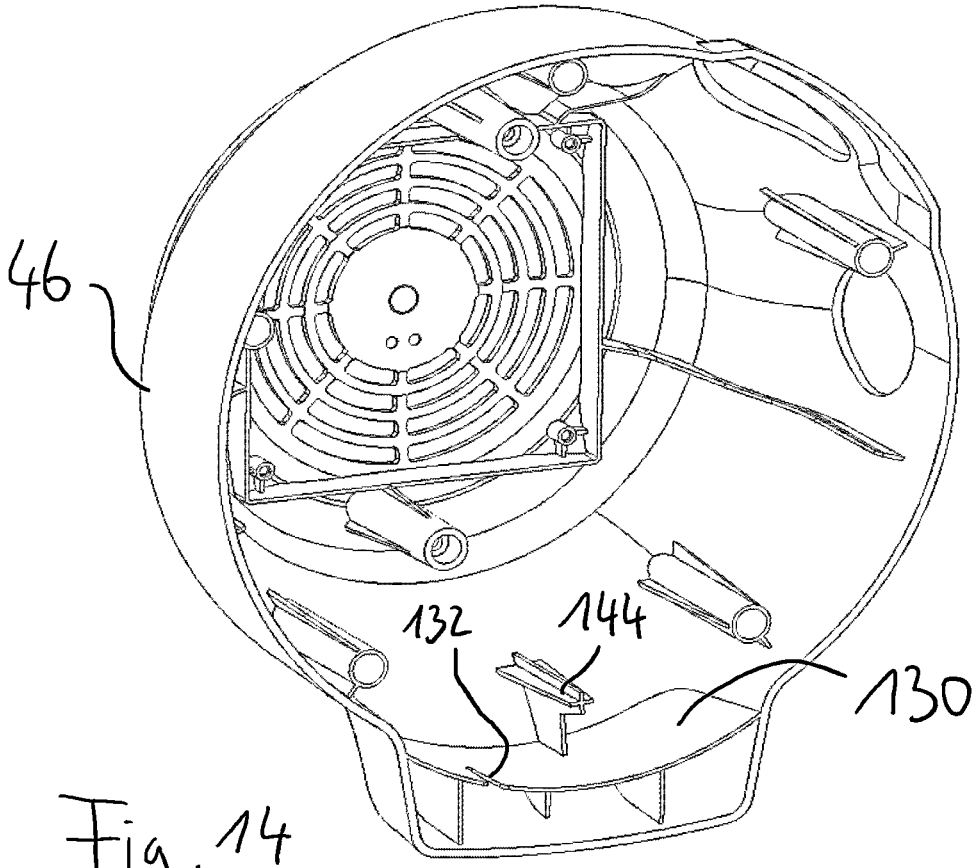
Fig. 14
Fig. 15
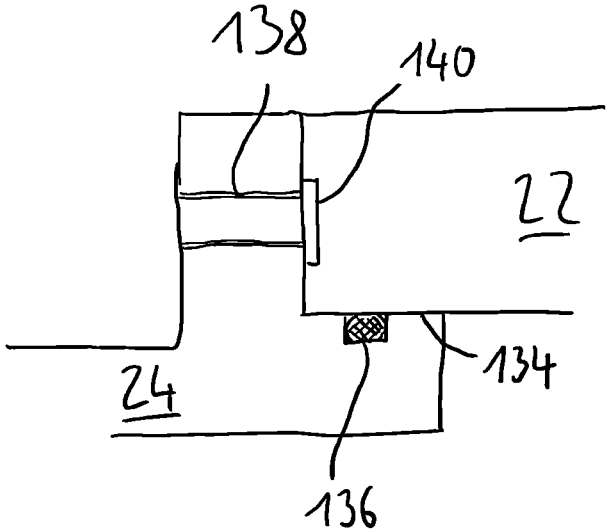

PUMP AND METHOD OF MANUFACTURING A SEALING

The present invention relates to a pump, in particular a vacuum pump, that, for example, comprises at least two conveying elements movable relative to one another; and at least one seal arranged on one of the two conveying elements. In accordance with the invention, a sealing is provided that is at least regionally applied to in particular at least one of the conveying elements. Furthermore, the invention relates to the use of components provided with a sealing and to the use of at least one seal for the manufacture of pumps, in particular vacuum pumps, and also to a method of manufacturing a sealing.

Fluids such as greases or oils can generally be used to seal a pumping space of pumps, in particular vacuum pumps. A piston pump, for example, generally has a gap between the pumping space and the piston. In a fluid-sealed or fluid-lubricated design, this gap is filled by a fluid, usually oil or grease, during the operation of the pump, with the fluid acting as a seal between the piston and the pumping space. Furthermore, defects in the surface structure (cracks, holes, pores, etc.) can act as a gap. Some coatings (lacquers, anodized layers, etc.) in particular have defects. A disadvantage of such pumps is that the media conveyed by the pump, such as gases or vapors, can react with the fluids used as seals, which can in particular reduce the sealing effect. A further problem, in particular with vacuum pumps, is contamination of the recipient by the fluids used.

For this reason, so-called dry solutions, in which the conveyed media do not come into contact with fluids, are in particular preferred for vacuum pumps. In this respect, sliding or grinding seals composed of chemically resistant materials, usually plastics, are generally used. In a piston pump, for example, such seals are usually arranged at the piston. During the operation, the seal grinds against an inner wall of a cylinder to seal the resulting pumping space as hermetically as possible. Another example of a pump that is usually likewise operated dry, i.e. without fluid lubricants, is a scroll pump or spiral pump. Scroll pumps have crescent-shaped suction spaces that are formed by a rotor of spiral shape in cross-section in engagement with a similar spiral stator, wherein the rotor is set into an orbiting movement by an eccentric drive. To seal the pumping spaces, seals are in each case provided at the spiral end faces, wherein the end-face seal of the rotor grinds against the stator and vice versa.

The disadvantage of such sliding or grinding seals is that they are usually subject to very severe wear, due to the constant sliding friction, and often only have a limited service life. An abrasion of the seals in the form of dust can in particular occur in the suction space after some operating time. As the wear increases, the sealing effect of the grinding seal decreases, whereby the achievable end pressure deteriorates.

To reduce wear, slide layers or protective layers can be provided, such as are described in EP 3 153 706 A1. Such sealings can comprise an oxide layer formed by anodic oxidation in an acidic electrolyte that in particular includes oxalic acid, sulfuric acid or mixtures thereof. These sealings/protective layers furthermore increase the corrosion resistance and wear resistance of the base material.

Very narrow gaps (a few 0.01 mm) are located between the crescent-shaped suction spaces. In the event of a contact of both components forming suction spaces or of solids that have entered, the hard slide layer and protective layer provides a longer service life of the base material. However, it has been found that, due to their porous structure, such oxide layers cannot achieve the required end pressures and gas tightnesses or only after a longer running time (so-called run-in time). Tests have indeed shown that, in particular in the case of newly coated components, reduced run-in times or improved end pressures can be achieved by a bake-out process of the coated components, but there is still a need for improvement with regard to the achievable end pressures and to a reduction of the run-in times.

An increased corrosion resistance is not only required for piston pumps and scroll pumps, but also for turbomolecular pumps. Turbomolecular pumps are vacuum pumps that have a rotor rotating about an axis of rotation of the rotor shaft. Pump-active components can be formed from a light metal, in particular aluminum, that is provided with an oxide layer to increase the corrosion resistance, similar to the above-mentioned slide layers or protective layers, such as are described in EP 3 153 706 A1.

During operation, the pump-active components come into contact with the pumped medium that can have a corrosive effect on the pump-active components. An electrolytic corrosion can then occur that starts at the pores in components provided with a porous oxide layer.

It is therefore an object of the present invention to provide pumps with an improved corrosion protection.

This object is satisfied by a pump and by a method in accordance with the independent claims.

The pump in accordance with the invention is preferably a vacuum pump. The pump comprises a pump-active component having a coating, wherein the coating comprises an oxide layer having pores and a fluorine-free polymer-based and/or sol-gel-based sealing, and wherein the pores of the oxide layer are at least partly covered by the sealing and/or impregnated with the sealing and/or filled with the sealing.

It has been found that in a pump in accordance with the invention, the pump-active component is protected from corrosion due to the sealing. The electrolytic corrosion that typically starts at the pores is in particular effectively prevented by the sealing in accordance with the invention. Due to the sealing, this corrosion protection is provided for different pump types, such as scroll pumps, turbomolecular pumps or piston pumps.

Furthermore, the sealing solves further tasks. In scroll and piston pumps, the sealing also acts as a slide layer so that two functions are fulfilled: 1) Slide layer/optimization of the tribological system. 2) Protective layer; protection of the base material against damage, wear, and corrosion. Tests have shown that without a hard surface coating in particular at scroll pumps, the base material can be damaged within a very short time.

The oxide layer is preferably formed by anodic oxidation, in particular in an acidic electrolyte. The electrolyte preferably has oxalic acid and/or sulfuric acid, wherein sulfuric acid is even further preferred. The oxide layer is preferably an anodized layer that was formed by an electrolytic oxidation of aluminum. This oxide layer can have the above-mentioned multifunctional properties with respect to a sliding and protective effect, provided that the sealing is applied to said oxide layer as described herein.

It has been found that a pump in accordance with the invention having a slide layer that comprises an oxide layer and a sealing, e.g. in the form of a fluorine-free polymer impregnation and/or a sol-gel impregnation, allows lower end pressures than slide layers, such as are described in EP 3 153 706 A1 or in EP 3 940 234 A2. The hard oxide layers applied for wear protection have pores, defects, and thermally induced cracks. The pores are mainly arranged perpendicular to the layer, wherein there are also some branchings within the layer that are arranged horizontally with respect to the layer and that connect the perpendicular pores to one another. In addition to the pores, such hard oxide layers have further defects, e.g. in the form of inclusions and cracks. Defects and pores represent microscopic channels through which gases can flow. Furthermore, substances, e.g. water, can degas from these points. The gas tightness is hereby reduced, which has an undesirable effect on the achievable end pressures. This means that, in particular in the case of scroll pumps, the required end pressures and gas tightnesses cannot be achieved or can only be achieved after a longer running time. During the so-called run-in process, pores and defects are largely closed at relevant points by the wear of the seal. Furthermore, a degassing of the enclosed media, e.g. coating residues, takes place. It has been found that the required end pressures can be achieved even faster by the sealing, wherein a high level of wear protection is simultaneously maintained. This can presumably be explained by the fact that, in the pump in accordance with the invention, pores included in the oxide layer are closed by the sealing and a gas flow within the sealed layer, e.g. the slide layer, or a degassing therefrom is prevented or at least reduced. Compared to the sealings or slide layers from the above-mentioned prior art, it is assumed that in the pump in accordance with the invention, the pores of the oxide layer are at least partly filled with the sol-gel-based material of the sealing or with a fluorine-free polymer. Cross-connections between perpendicular pores, i.e. the branchings arranged horizontally to the layer, are hereby also sealed. An even shorter run-in time than with the known slide layers is thereby achieved.

In contrast to the prior art, as described in EP 3 153 706 A1 or in EP 3 940 234 A2, the polymer-based sealing is fluorine-free. "Fluorine-free" is used herein to describe materials that contain essentially no fluorine. This means that fluorine-containing compounds may indeed be present in the form of impurities or other additives, but they do not significantly alter the basic properties of the sealing, i.e. the improvement in corrosion protection. "Fluorine-free" herein preferably refers to a fluorine content of less than or equal to 100 ppm (=100 μg/g). The fluorine content can, for example, be determined by means of X-ray fluorescence measurements.

The present invention further relates to a method of coating a pump-active component of a pump. The method in accordance with the invention comprises the following steps: step A) providing the pump-active component composed of a light metal workpiece and having a porous oxide layer on a surface, step B) exposing the pump-active component to a negative pressure, step C) contacting the porous oxide layer with a solution comprising at least one polymerizable sealing precursor that is in particular fluorine-free and/or at least one sol-gel-based sealing precursor, wherein a voltage is applied to the pump-active part during at least one of the steps A) to C).

Due to the method in accordance with the invention, the porous oxide structure on the surface of a pump-active component is sealed and is thereby protected from corrosion. Since a negative pressure is applied in the method in accordance with the invention, inclusions are removed from the pores of the oxide structure. On the one hand, the sealing precursor can hereby penetrate better and deeper into the pores. On the other hand, moisture is removed from the oxide layer, whereby even less wear of the sealed oxide layer results.

The light metal workpiece is in particular an aluminum workpiece, e.g. composed of one of the aluminum alloys mentioned herein.

By applying a voltage, a transport of the sealing precursors into the pores of the oxide layer takes place so that a very deep penetration of the pores with the sealing is achieved. It is assumed that due to this penetration, both horizontal pores and vertical branchings are sealed by the method in accordance with the invention. The achievable end pressures and the required run-in times are thereby very low/small.

The present invention further relates to a pump comprising a pump-active component obtainable by the method in accordance with the invention.

In accordance with a preferred embodiment of the present invention, the pump in accordance with the invention is preferably a spiral pump or scroll pump, in particular a spiral vacuum pump or scroll vacuum pump, comprising conveying elements formed as spiral elements. The sealed oxide layer is particularly preferably provided at least for a tip seal. Here, the sealing is at least regionally applied to at least one of the conveying elements formed as spiral elements. In the case of spiral or scroll pumps, the present invention solves additional tasks, such as a reduction of the run-in time with simultaneously low achievable end pressures.

In accordance with an alternative embodiment, the pump in accordance with the invention is a piston pump, in particular a piston vacuum pump. The piston pump has at least one cylinder, which has an inner cylinder wall, and a piston movable in the cylinder. In this embodiment of the invention, the sealing is at least regionally applied to the inner cylinder wall and/or the piston. Similar to the embodiment of the scroll pump, in the case of the piston pump, the sealing acts as a slide layer of the pump-active components. The tightness and the run-in times are thereby reduced.

In accordance with a further preferred embodiment, the pump in accordance with the invention is a turbomolecular pump, wherein the sealing is at least regionally applied to rotor disks and/or stator disks. With conventional porous oxide layers on pump-active components, an electrolytic corrosion starts at the pores of the oxide layer. Since the pores of this oxide layer are sealed in the present invention, the electrolytic oxidation cannot take place either. The improvement in the corrosion resistance therefore improves the longevity of the turbomolecular pump in accordance with this preferred embodiment of the invention.

The pump-active component is preferably formed from a light metal material. The light metal material is preferably an aluminum alloy, wherein the present invention is not limited thereto. Aluminum alloys of the 4000 series, 5000 series and 6000 series have proven to be particularly suitable, with the aluminum alloys of the 6000 series being particularly preferred. Exemplary representatives for aluminum alloys of the 6000 series are AlMgSi1 (EN AW-6082) and AlMgSi0.5 (EN AW-6060).

The surface of the pump-active component has an oxide layer. This oxide layer can be formed in different manners. Known processes for this purpose are, for example, anodizing. In the present invention, the pump-active component is preferably formed from one of the aforementioned aluminum alloys that is provided with an oxide layer by anodizing in an acidic electrolyte. The acidic electrolyte can, for example, be a sulfuric acid electrolyte or an oxalic acid electrolyte, wherein the electrolyte can also include mixtures of these and other acids as well as other additives.

In the pump in accordance with the invention, a layer thickness of the sealing is preferably less than or equal to 5

μm, more preferably less than or equal to 3 μm, even more preferably less than or equal to 1 μm. In the manufacturing method in accordance with the invention, the layer thickness of the sealing can be influenced by varying the concentration and the type of the precursor compound, e.g. an acrylate salt and/or a derivative thereof, by the current intensity and by the duration of the treatment of the pump-active component. This layer thickness can, for example, be determined by means of electron micrographs.

In the method in accordance with the invention, it is preferred if in step C) the solution includes ions and/or ionic compounds. By applying a voltage during the method in accordance with the invention, the se ions or ionic compounds can penetrate deep into the pores of the oxide layer to then provide the sealing there. Due to the deep penetration into the pores, even deep-lying horizontal branchings of the porous oxide layer are sealed.

Furthermore, in the method in accordance with the invention, it is preferred that at least one compound, i.e. a precursor compound for forming the sealing, having functional groups from the families of the organic anions, such as the substituted acrylates and/or substituted acetates and/or substituted styrenes and/or substituted isocyanates and/or carboxyls and/or sulfonic acid, and/or from the family of inorganic ions, such as silicates, aluminates, is included in the solution of step C). In particular substituted acrylates are preferred. Via the carboxylic acid of the acrylate function, a polymerizable but ionic compound can be transported deep into the pores of the porous oxide layer by means of the electrical voltage so that a deep sealing is possible. The solution of step C) therefore particularly preferably comprises salts of acrylic acid and/or salts of acrylic acid derivatives. The salts of the acrylic acid and/or the acrylic acid derivatives can be dissolved or dispersed in the solution of step C). However, the present invention is not limited to acrylates and their derivatives.

The concentration of the compound having functional groups is preferably in the range from 1.0 to 25% by weight, more preferably in the range from 3 to 20% by weight, and even more preferably in the range from 5 to 15% by weight.

The solution of step C) is preferably an aqueous solution, in particular an aqueous acrylate salt solution in the form of an ionogenic dispersion.

In the present invention, it has been found to be advantageous to successively increase the voltage during the treatment of the pump-active component. The voltage is preferably between 40 and 300 V, in particular between 50 and 150 V.

The current density in the method in accordance with the invention is preferably in the range from 0.25 to 20 $A/dm^2$, more preferably in the range from 0.5 to 15 $A/dm^2$, even more preferably in the range from 1.0 to 10 $A/dm^2$, most preferably in the range from 1.5 to 7.0 $A/dm^2$.

In the method in accordance with the invention, it has been found to be advantageous to apply the voltage to the pump-active component using a direct current. The precursors of the sealing are hereby transported deep into the pores of the oxide layer to form the sealing there. Within the pores, the precursor compounds, e.g. an acrylate salt and/or a derivative thereof, are deposited or precipitated so that the sealing forms within the pores. This results in a deep impregnation that also closes horizontal branchings of the porous structure.

In accordance with a preferred embodiment of the method in accordance with the invention, the pump-active component is heat-treated after completion of the electrochemical treatment. The heat treatment is preferably performed at a temperature in the range from 80° C. to 300° C., in particular in the range from 100 to 230° C. During the heat treatment, the sealing is formed from the precursors of the sealing. Furthermore, due to the heat treatment, moisture in the porous layer of the pump-active component can be reduced, which has an advantageous effect on the tribological wear.

In a preferred variant of the present method in accordance with the invention, the sealing precursor is precipitated in the pores during the electrochemical treatment. In particular in the case of sol-gel based sealings, the precursors of the sealing, i.e. a sol, first penetrate into the pores of the oxide layer. The precipitation then takes place simultaneously with the formation of the gel, i.e. the sealing. Since the sol can penetrate very deep into the pores, the sealing also takes place deep in the pores. The pores are thereby at least partly filled and in particular horizontal branchings are sealed.

In accordance with a further preferred variant of the present method in accordance with the invention, the sealing precursor is polymerized in the pore. The sealing precursor is present here, for example as a monomer or as a prepolymer, and can penetrate deep into the pores of the oxide layer in the form of a solution or dispersion. Due to the polymerization, the size of the monomers or prepolymers is increased so that they bring about a sealing within the pores and remain in the pores. Due to the polymerization, the solubility of the monomers or prepolymers can also change so that they precipitate in the pores and cause a deep sealing, even of horizontal branchings in the porous structure of the oxide layer.

In accordance with a further preferred variant of the present method in accordance with the invention, in step B), the pump-active component provided in step A) is exposed to a negative pressure, i.e. the negative pressure is applied after the porous oxide layer has been generated. In principle, the generation of the porous oxide layer can also already take place under negative pressure. The pump-active component is preferably subjected to the further process without further drying after the generation of the oxide layer. Provided that a drying takes place after the generation of the oxide layer, e.g. by anodizing, the pores can be closed by natural oxidation, whereby the quality of the sealing is impaired. Therefore, after a generation of the oxide layer on the surface of the pump-active component, the further process is preferably carried out without further drying and/or inclusions. In other words, the sealing is preferably performed wet-on-wet, i.e. with only an optional rinse between the generation of the oxide layer, e.g. by anodizing, and the further process.

The method in accordance with the invention is preferably part of the manufacture of a pump, in particular a vacuum pump, as is described herein.

In accordance with a preferred variant of the present invention, the pump in accordance with the invention having a pump-active component that is obtainable by the method described herein is a pump having all the details that are here also described independently of the method in accordance with the invention for pumps.

The invention will be explained only by way of example in the following with reference to the schematic drawings and to the examples.

Figure 1:
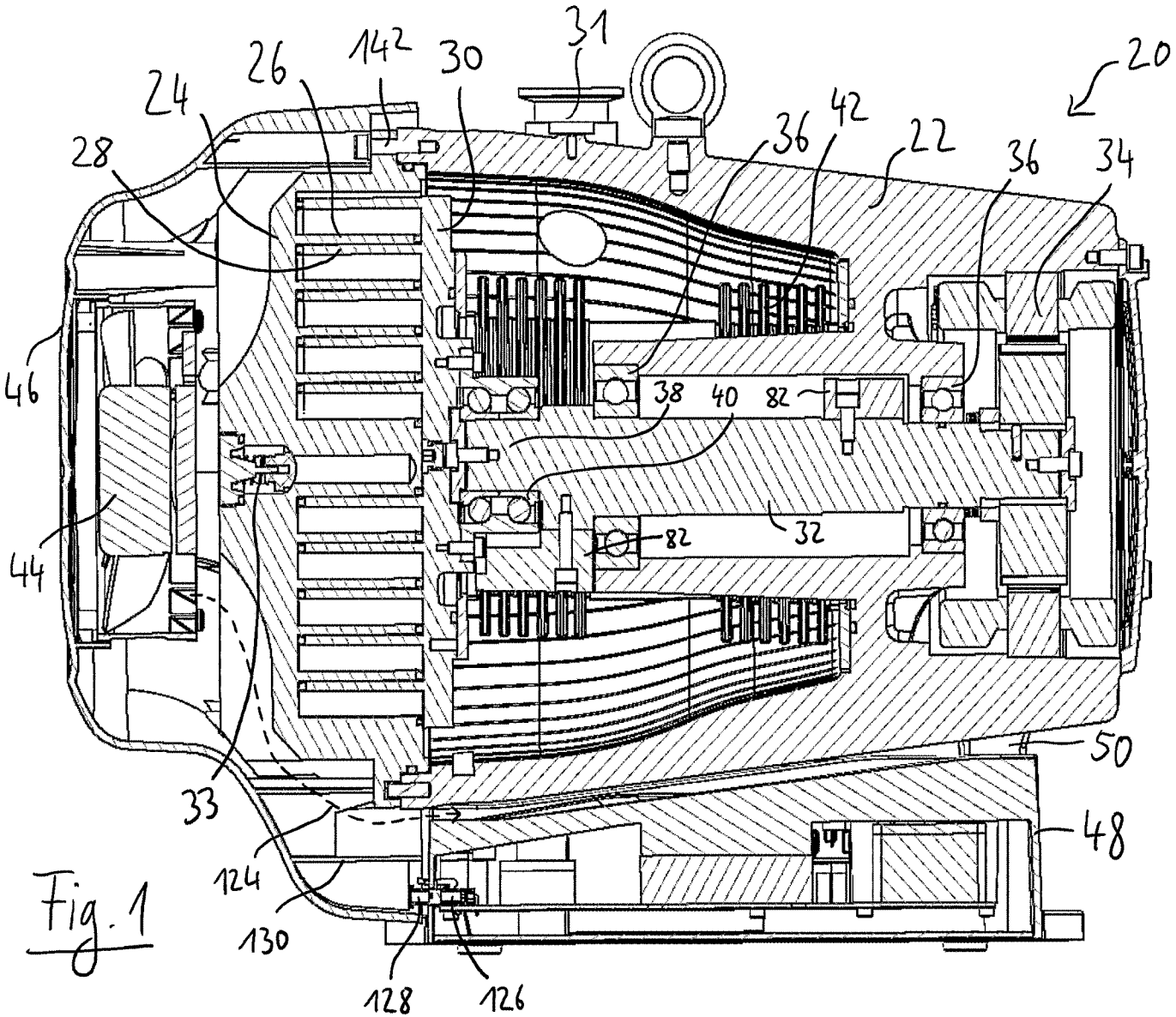
FIG. 1 shows a scroll pump in a sectional view.
Figure 5:
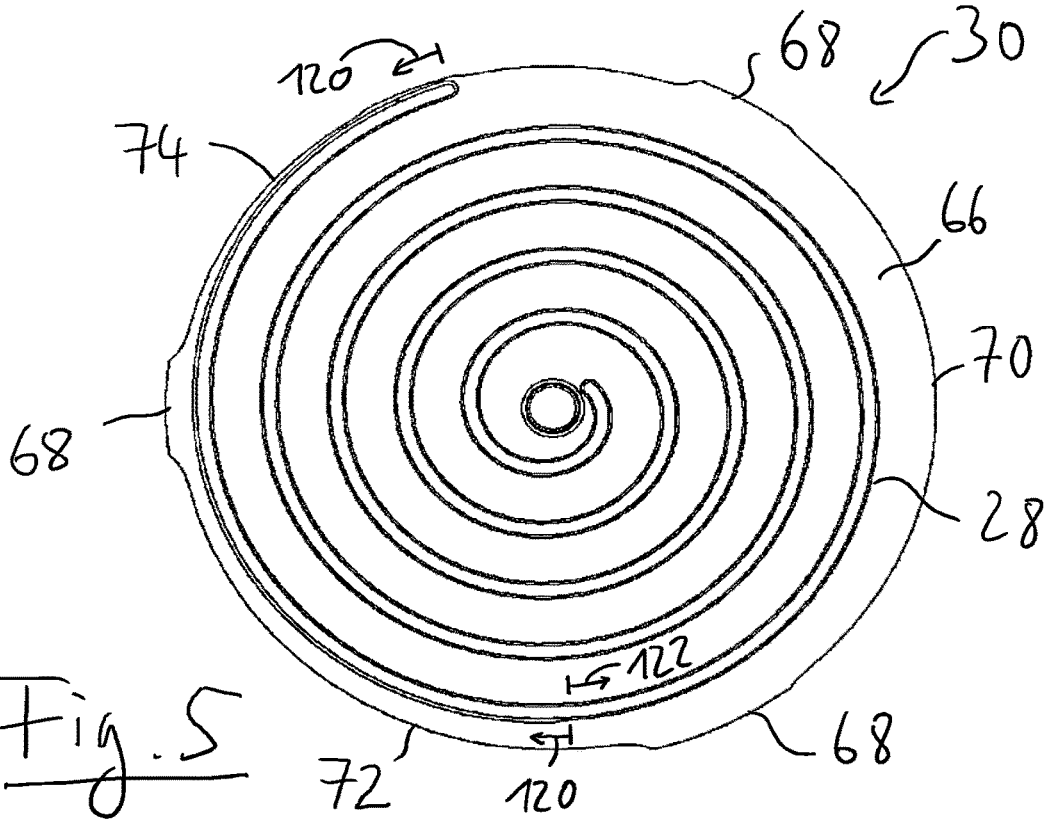
FIG. 5 shows a movable spiral component of the pump.
Figure 6:
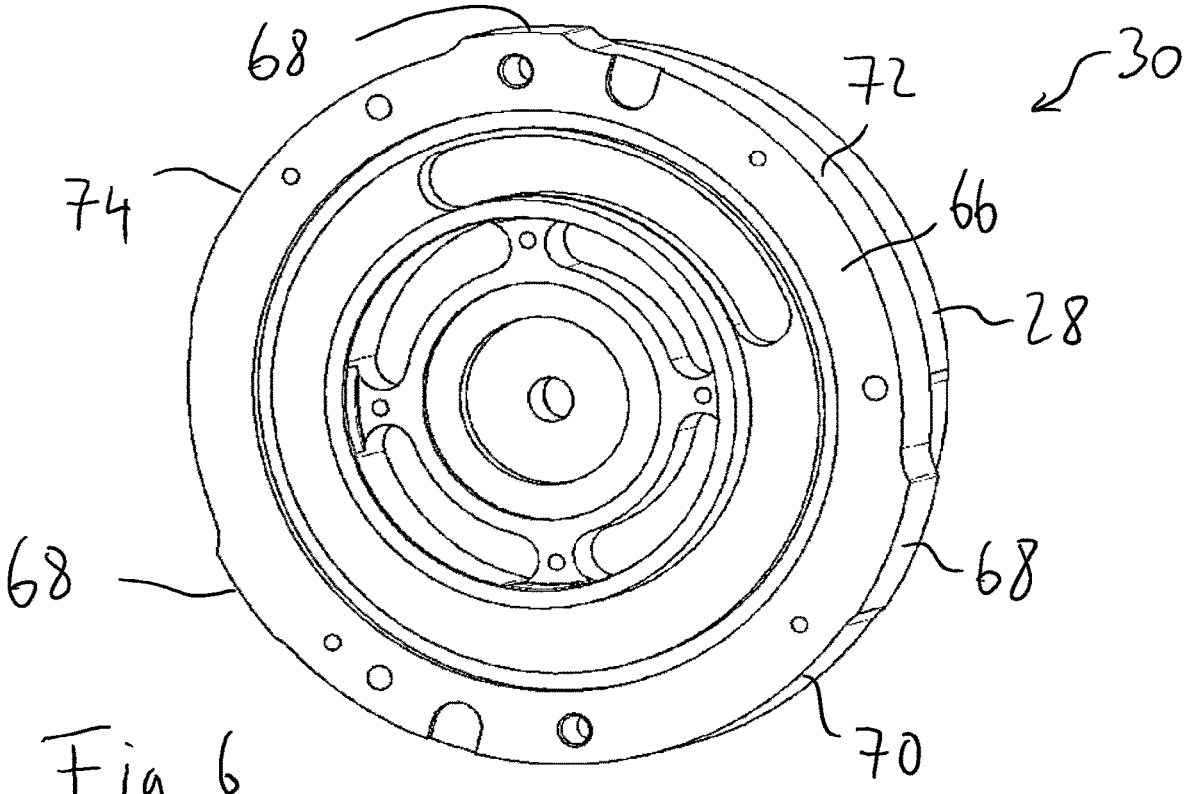
FIG. 6 shows the spiral component from another side disposed opposite the side visible in FIG. 5.
Figure 8:
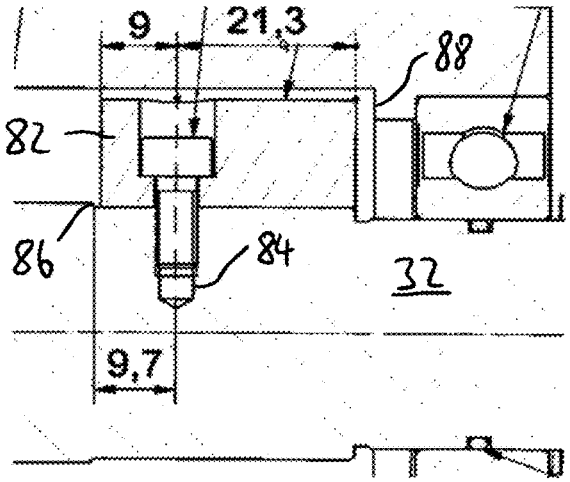
Figure 9:
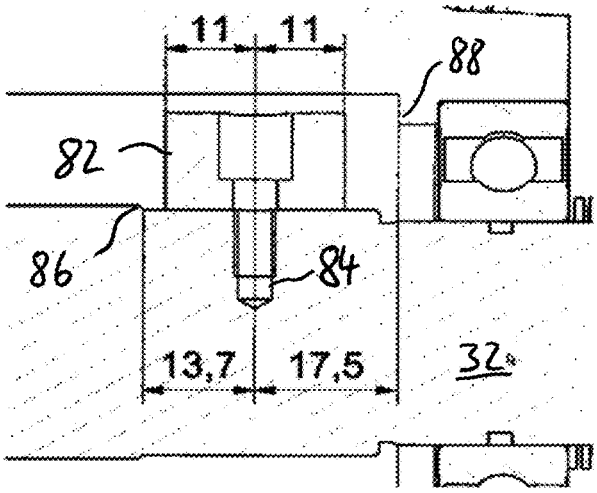
Figure 10:
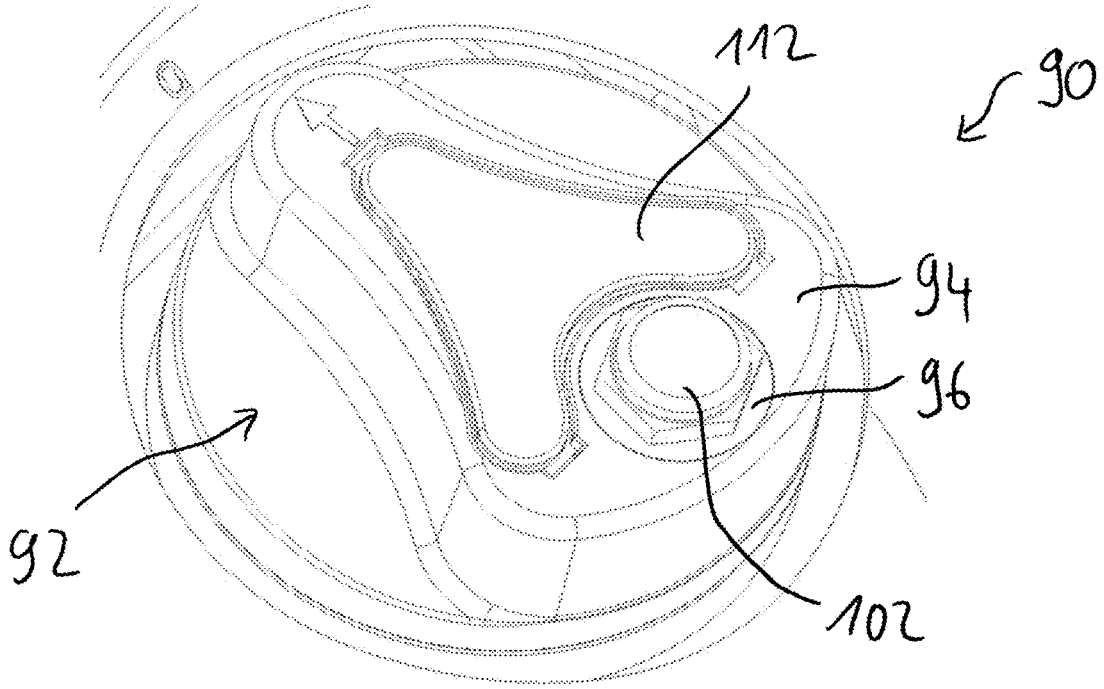
Figure 11:
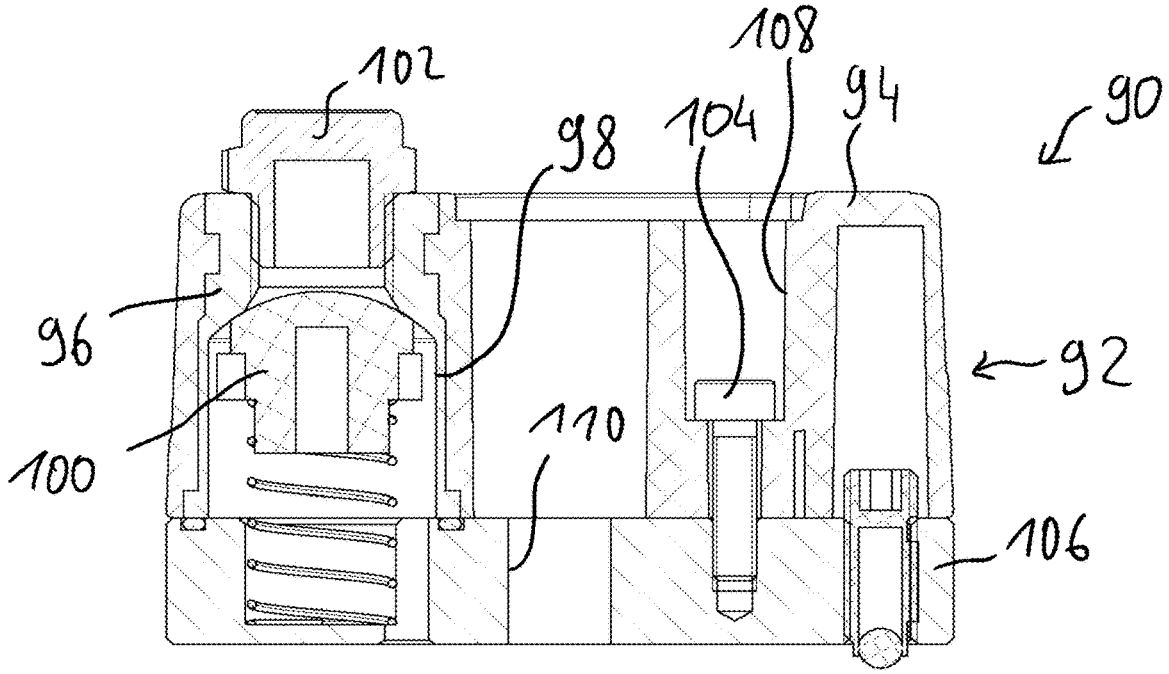
Figure 12:
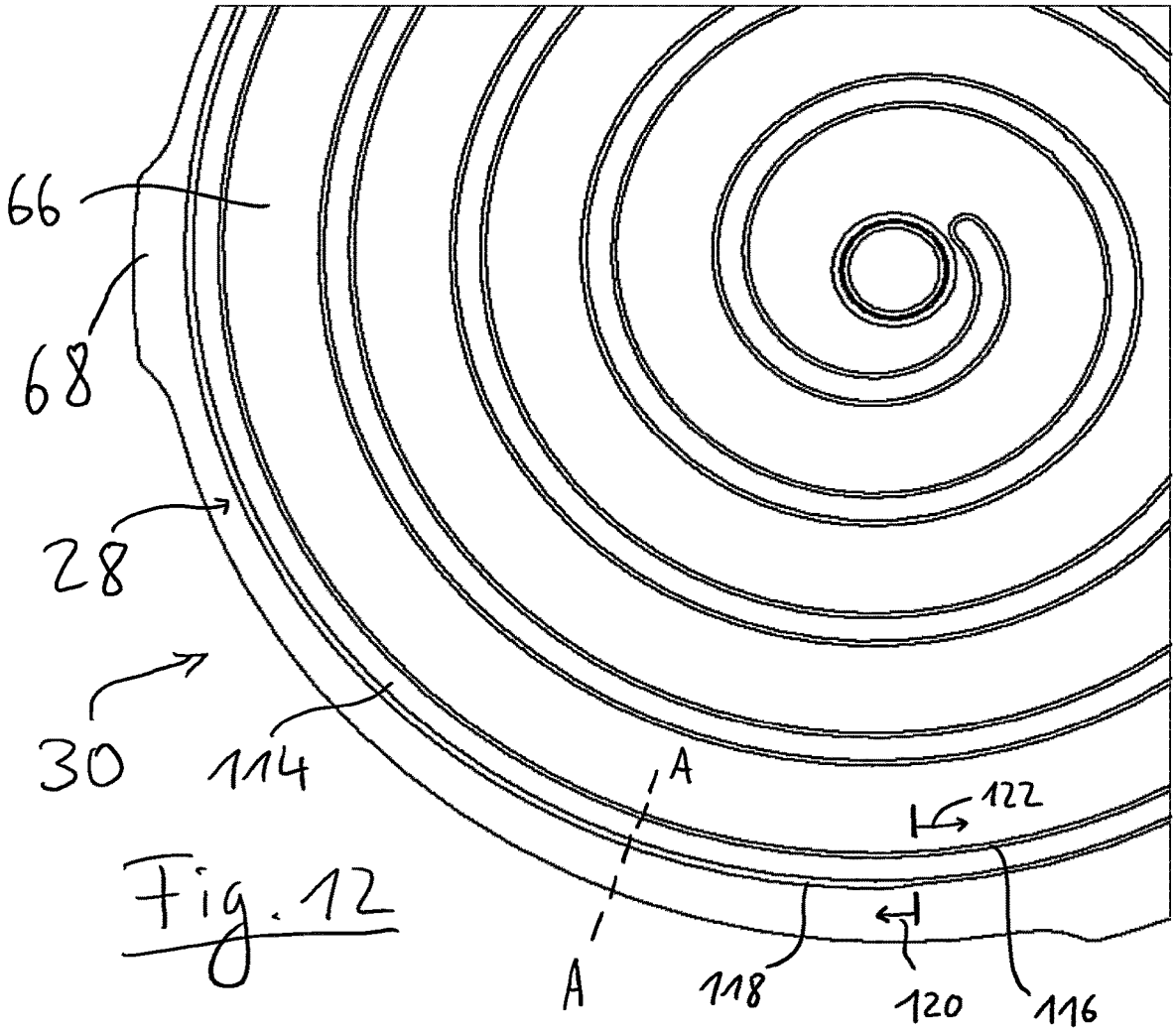
Figure 13:
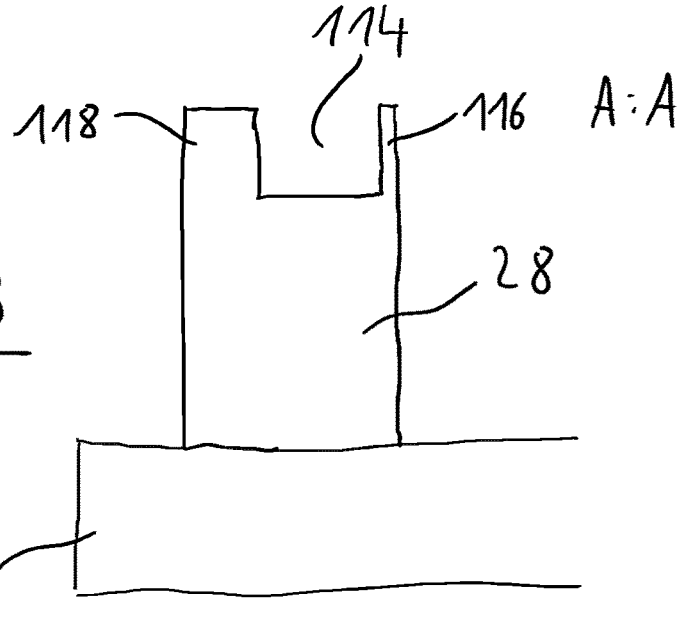
Figure 16:
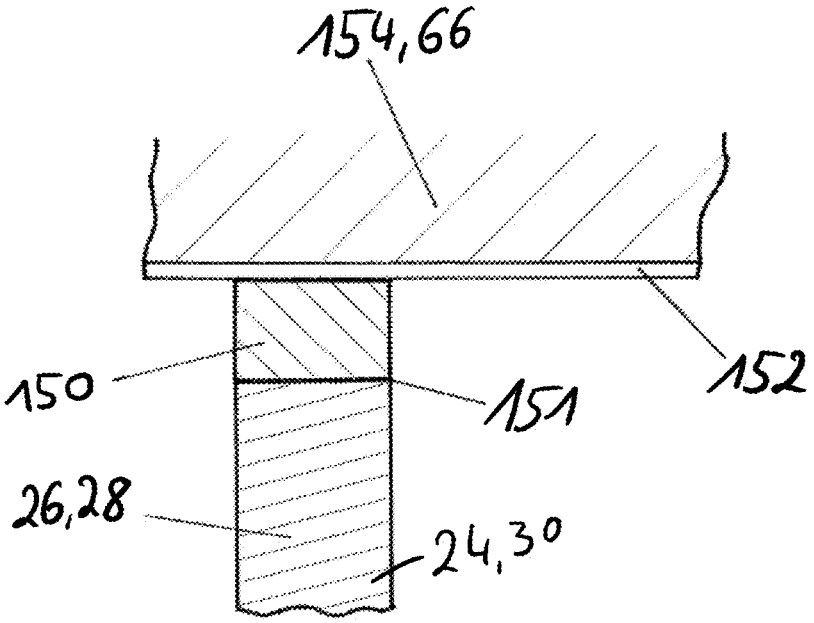
Figure 17:
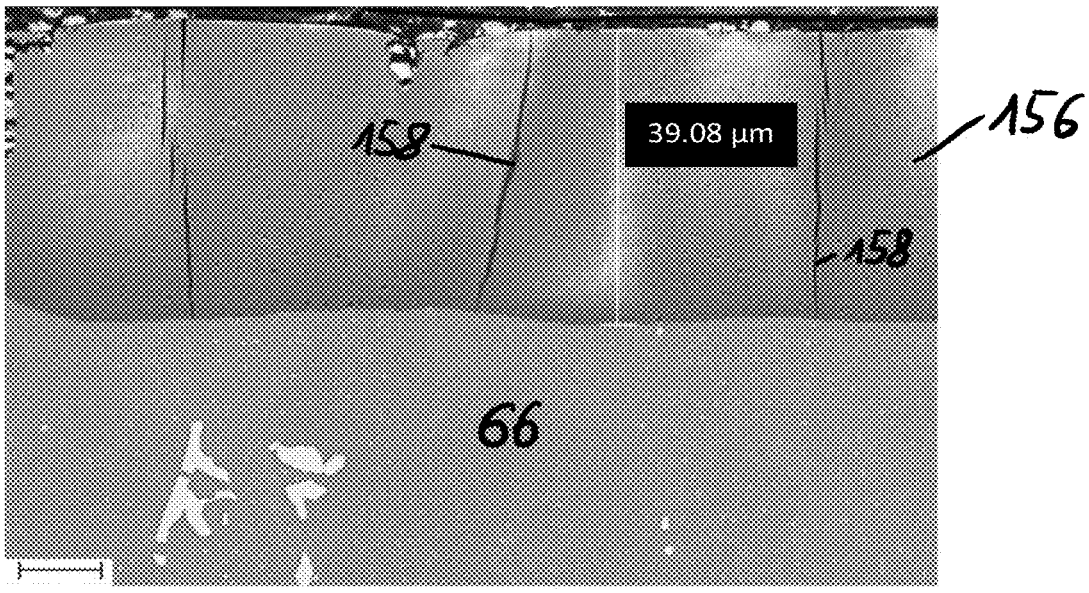
Figure 18:
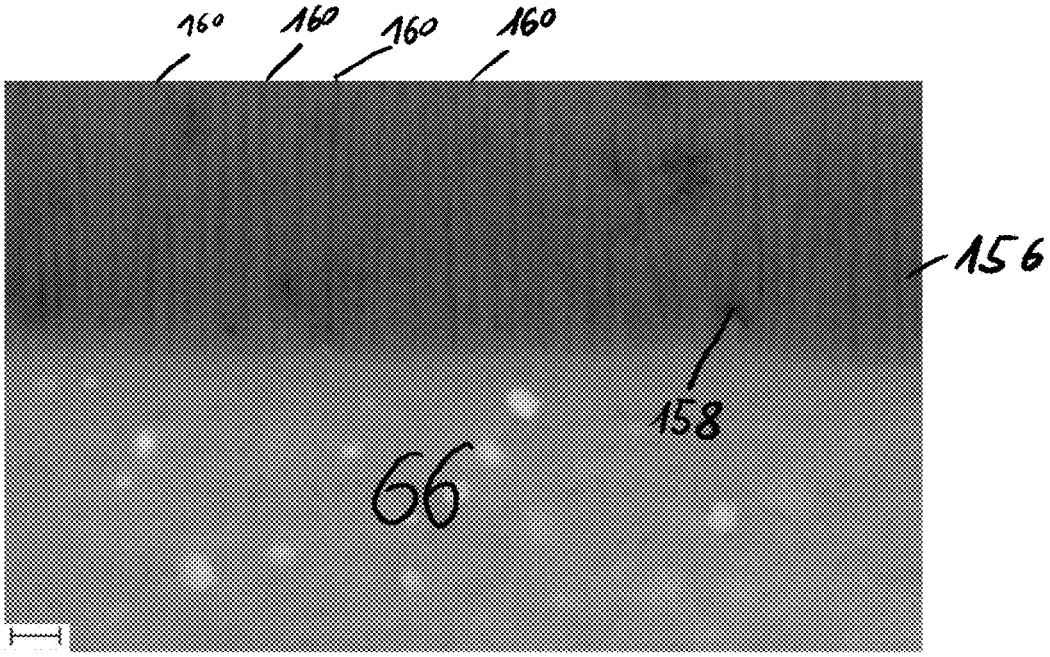
Figure 19:
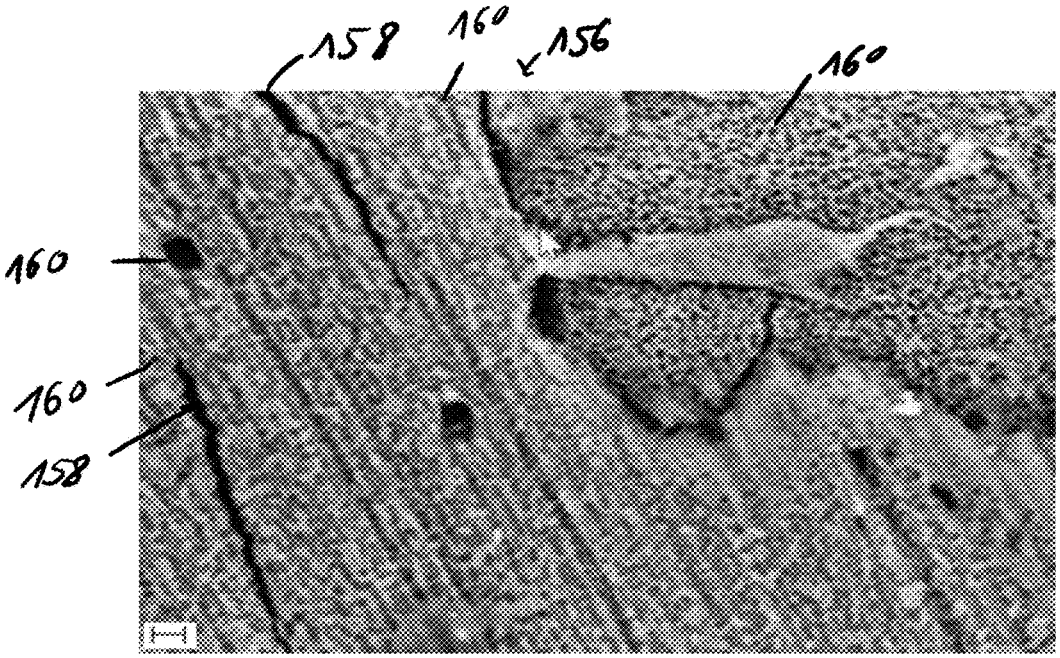
Figure 20:
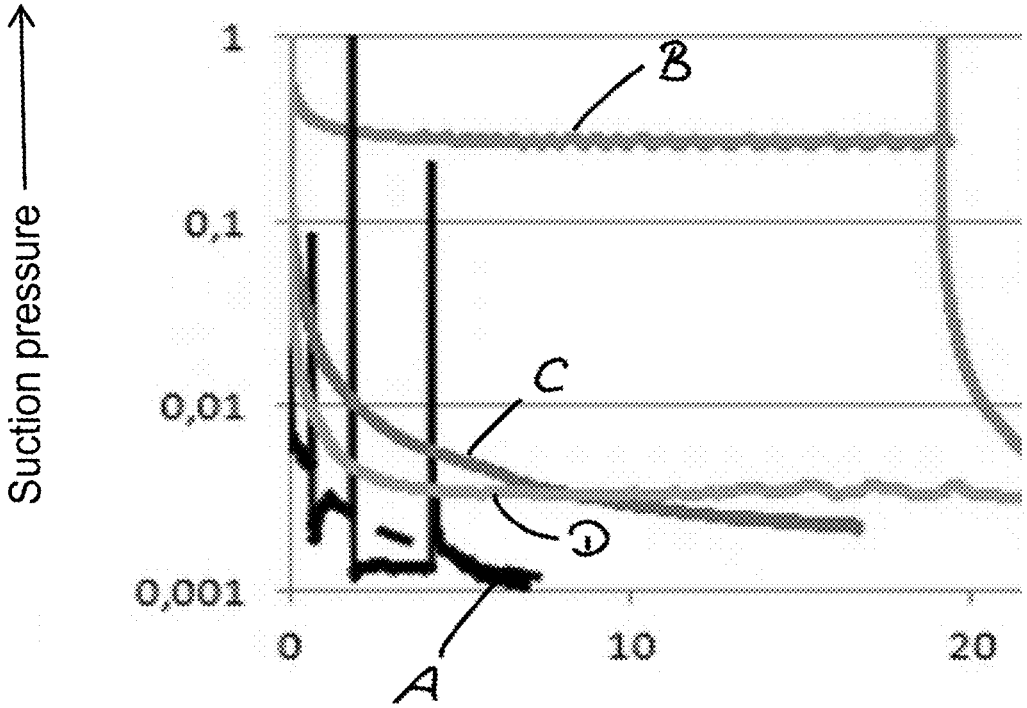
Figure 21:
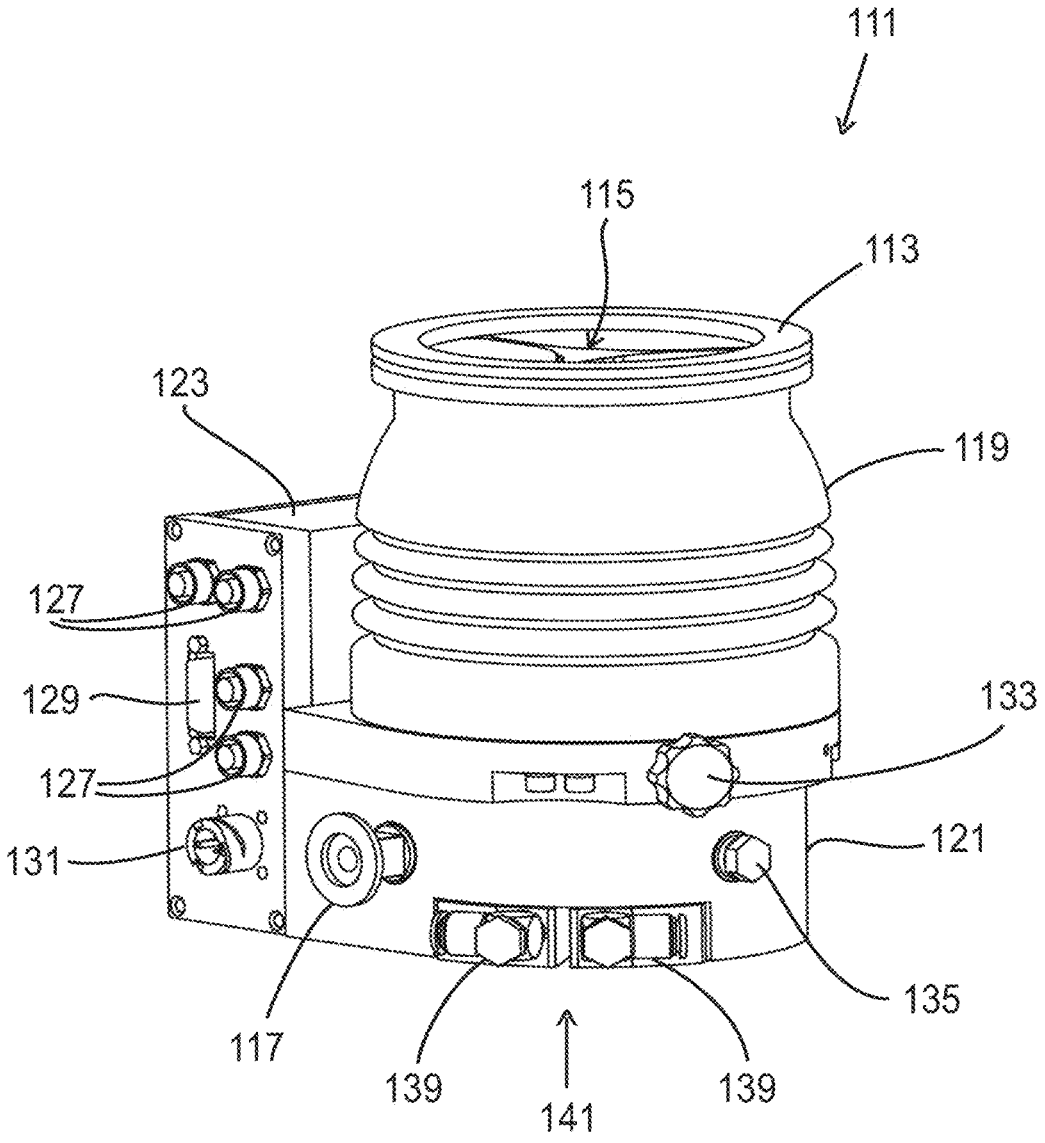
Figure 22:
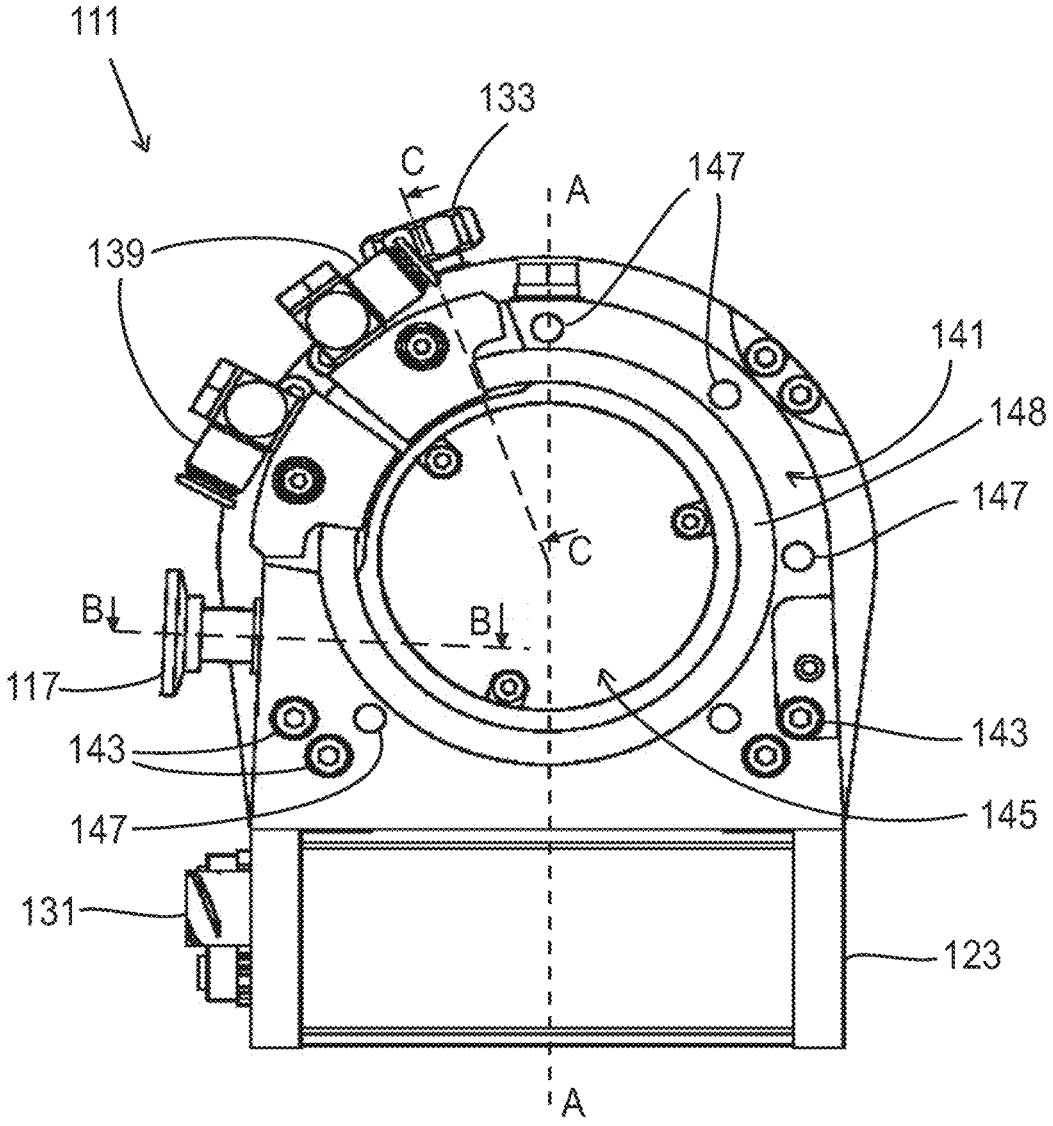
Figure 23:
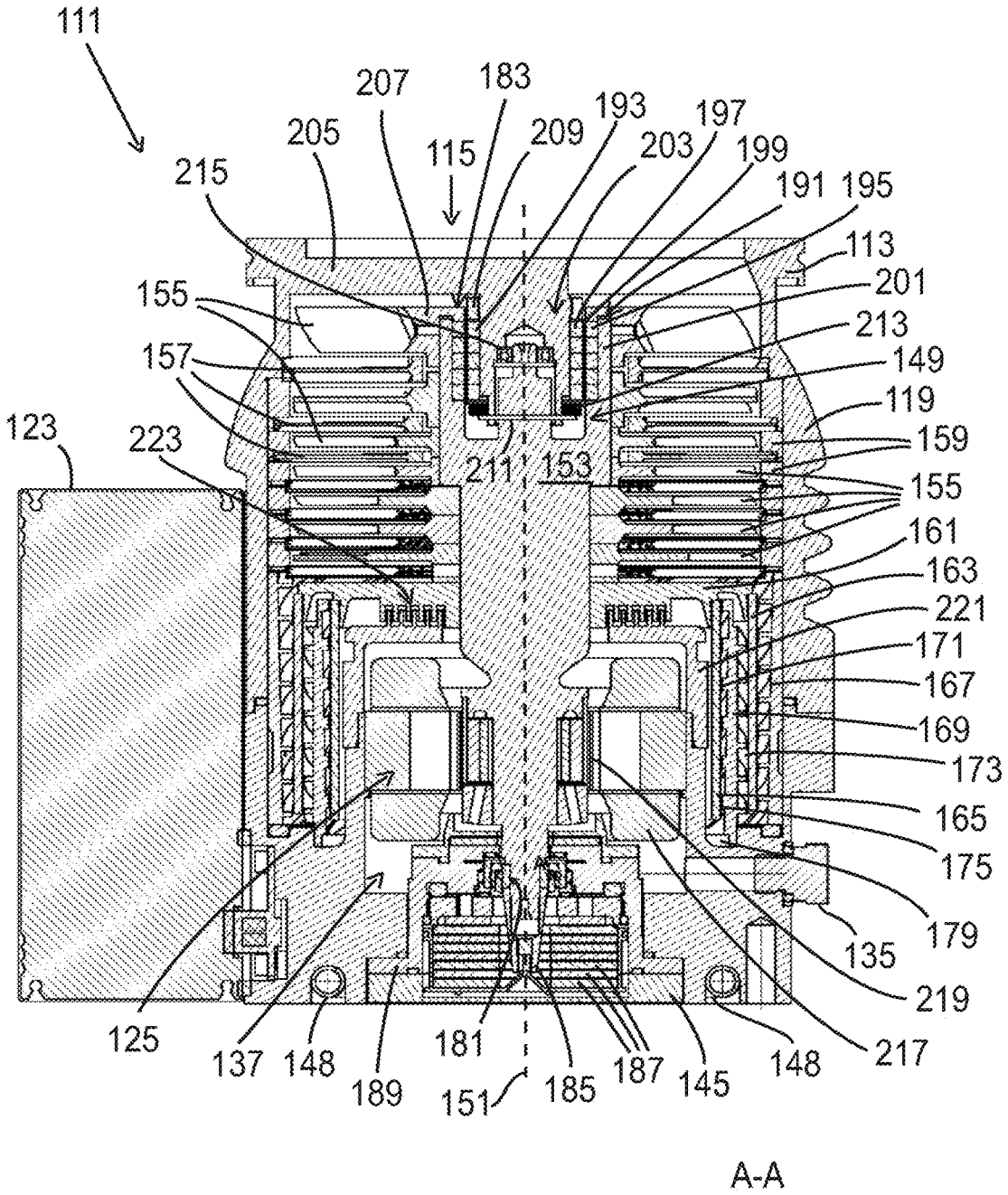
Figure 24:
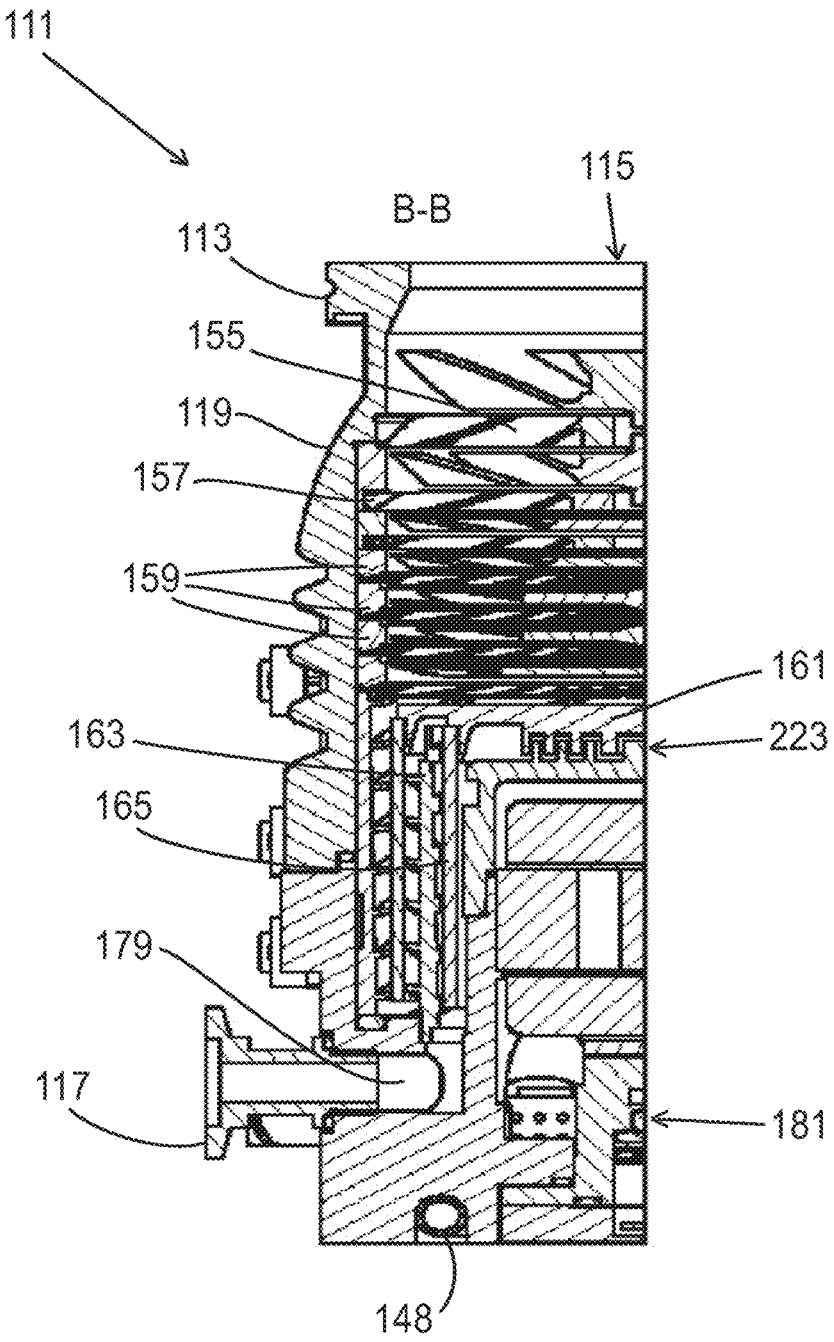
Figure 25:
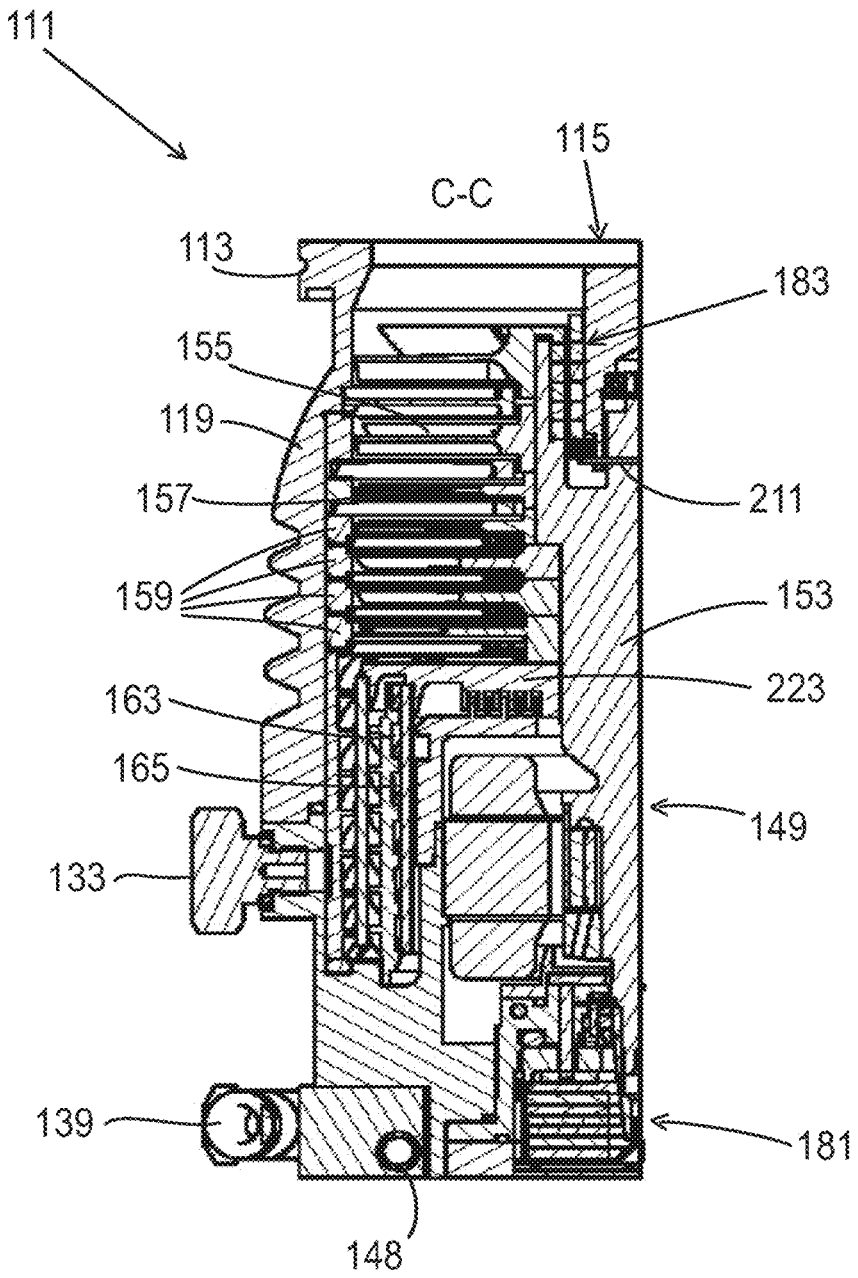

FIGS. 8 and 9 each show an eccentric shaft with a balance weight of different scroll pumps;

FIG. 10 shows a gas ballast valve with an actuation grip in a perspective view;

FIG. 11 shows the valve of FIG. 10 in a sectional view;

FIG. 12 shows a part region of the spiral component of FIGS. 5 and 6;

FIG. 13 shows a cross-section of the spiral component through the spiral wall in an outer end region;

FIG. 14 shows an air guide hood of the scroll pump of FIG. 1 in a perspective view;

FIG. 15 shows a forcing-off thread in a sectional representation;

FIG. 16 shows a detailed representation of the spiral pump or scroll pump of FIG. 1;

FIG. 17 shows an electron-microscopic cross-sectional view of an oxide layer;

FIG. 18 shows a greatly enlarged electron-microscopic cross-sectional view of the oxide layer of FIG. 16;

FIG. 19 shows an electron-microscopic view of the oxide layer of FIGS. 16 and 17;

FIG. 20 shows the development of the vacuum when using a scroll pump with differently coated or uncoated conveying elements;

FIG. 21 shows a perspective view of a turbomolecular pump;

FIG. 22 shows a view of the lower side of the turbomolecular pump of FIG. 21;

FIG. 23 shows a cross-section of the turbomolecular pump along the line A-A shown in FIG. 22;

FIG. 24 shows a cross-sectional view of the turbomolecular pump along the line B-B shown in FIG. 22; and FIG. 25 shows a cross-sectional view of the turbomolecular pump along the line C-C shown in FIG. 22.

Even if the present invention is not limited to scroll pumps 20, as it is depicted by way of example in FIGS. 1 to 16, it has been found to be very suitable for this purpose. In principle, the pump in accordance with the invention can also be a turbomolecular pump (see the exemplary description based on FIGS. 21 to 25) or a piston pump (not shown in the Figures).

FIG. 1 shows a vacuum pump configured as a scroll pump 20. It comprises a first housing element 22 and a second housing element 24, wherein the second housing element 24 has a pump-active structure, namely a spiral wall 26. The second housing element 24 therefore forms a fixed-position spiral component of the scroll pump 20. The spiral wall 26 cooperates with a spiral wall 28 of a movable spiral component 30, wherein the movable spiral component 30 is eccentrically excited via an eccentric shaft 32 to generate a pumping effect. In this respect, a gas to be pumped is delivered from an inlet 31, which is defined in the first housing element 22, to an outlet 33 which is defined in the second housing element 24.

The eccentric shaft 32 is driven by a motor 34 and is supported by two rolling element bearings 36. It comprises an eccentric pin 38 that is arranged eccentrically with respect to its axis of rotation and that transmits its eccentric deflection to the movable spiral component 30 via a further rolling element bearing 40. For the purpose of sealing, a left-side end of a corrugated bellows 42 in FIG. 1 is additionally fastened to the movable spiral component 30 and the right-side end of said corrugated bellows 42 is fastened to the first housing element 22. The left-side end of the corrugated bellows 42 follows the deflection of the movable spiral component 30.

The scroll pump 20 comprises a fan 44 for generating a cooling air flow. For this cooling air flow, an air guide hood 46 is provided to which the fan 44 is also fastened. The air guide hood 46 and the housing elements 22 and 24 are shaped such that the cooling air flow substantially flows around the total pump housing and a good cooling performance is thus achieved.

The scroll pump 20 further comprises an electronics housing 48 in which a control device and power electronics components for driving the motor 34 are arranged. The electronics housing 48 additionally forms a foot of the pump 20. A channel 50, through which an air flow generated by the fan 44 is guided along the first housing element 22 and also along the electronics housing 48 so that both are effectively cooled, is visible between the electronics housing 48 and the first housing element 22.

Figure 2:
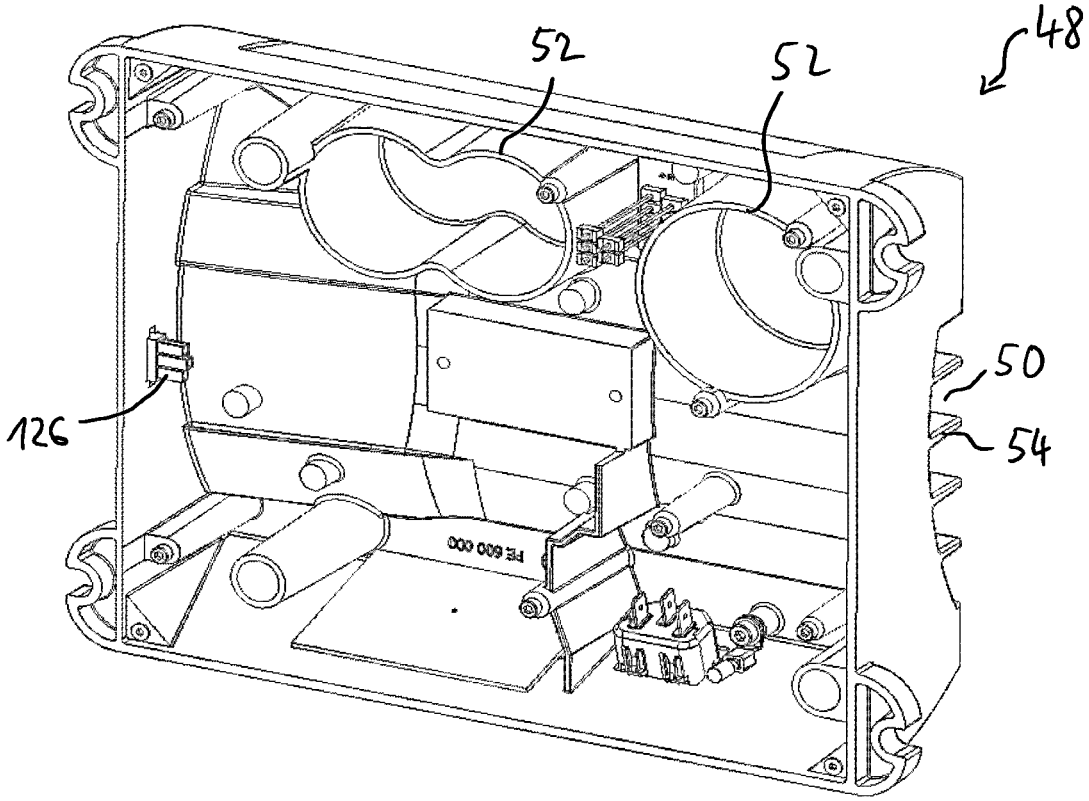
FIG. 2 shows an electronics housing of the scroll pump.

The electronics housing 48 is illustrated in more detail in FIG. 2. It comprises a plurality of separate chambers 52. Electronic components can be cast in these chambers 52 and are thus advantageously shielded. A quantity of the casting material that is as minimal as possible can preferably be used when casting the electronic components. For example, the casting material can first be introduced into the chamber 52 and the electronic component can subsequently be pressed in. The chambers 52 can preferably be designed such that different variants of the electronic components, in particular different equipping variants of a circuit board, can be arranged and/or can be cast in the electronics housing 48. For specific variants, individual chambers 52 can in this respect also remain empty, i.e. not have any electronic components. A so-called modular system can thus be implemented in a simple manner for different pump types. The casting material can in particular be thermally conductive and/or electrically insulating.

A plurality of walls or ribs 54 that define a plurality of channels 50 for conducting a cooling air flow are formed at a side of the electronics housing 48 that is the rear side with respect to FIG. 2. The chambers 52 also enable a particularly good heat dissipation from the electronic components arranged in them, in particular in connection with a thermally conductive casting material, and toward the ribs 54. The electronic components can thus be cooled particularly effectively and their service life is improved.

Figure 3:
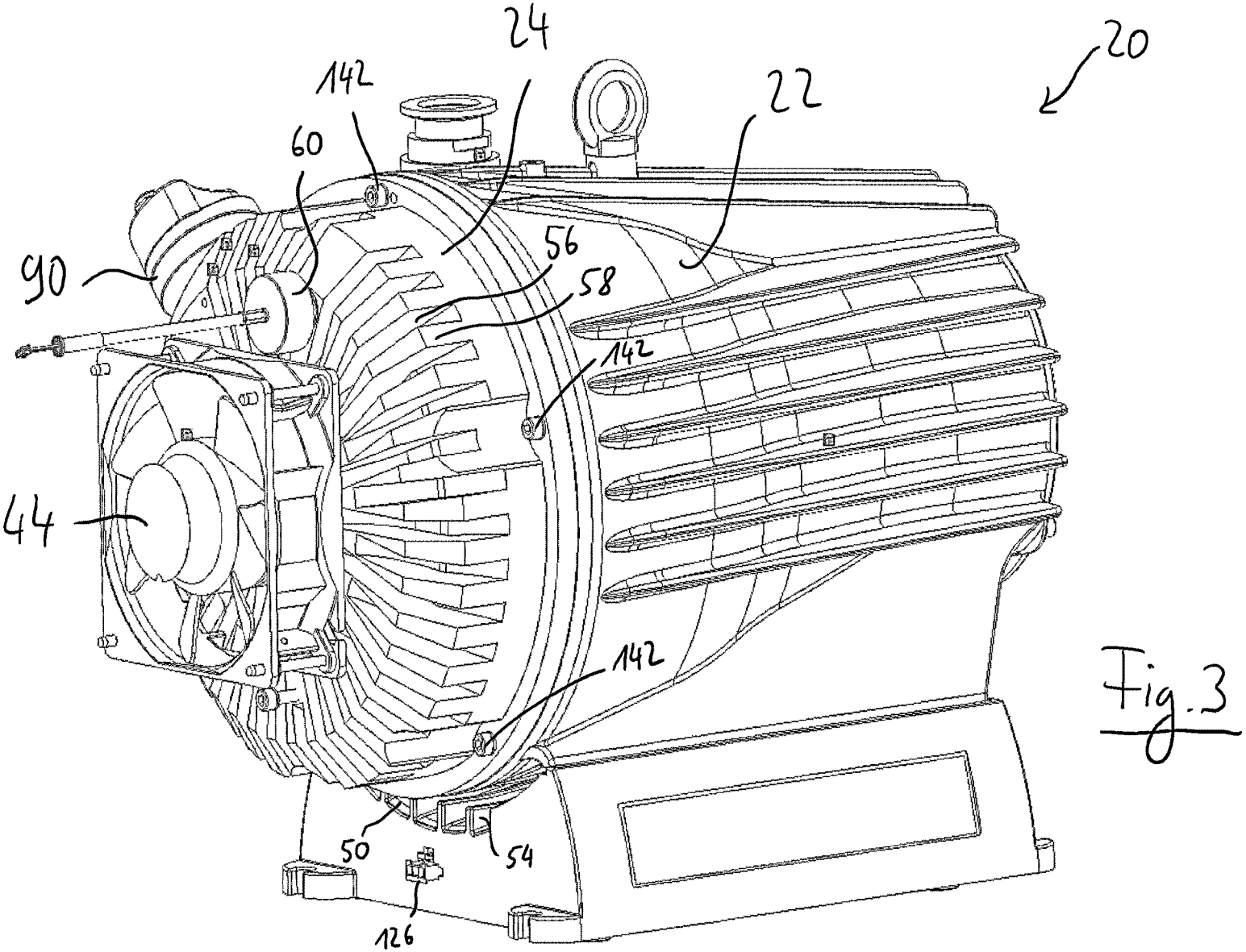
FIG. 3 shows the scroll pump in a perspective view, wherein selected elements are exposed.

In FIG. 3, the scroll pump 20 is shown perspectively as a whole, however, with the air guide hood 46 being masked so that the fixed-position spiral component 24 and the fan 44 are in particular visible. A plurality of recesses 56 arranged in a star shape are provided at the fixed-position spiral component 24 and each define ribs 58 arranged between the recesses 56. The cooling air flow generated by the fan 44 passes through the recesses 56 and past the ribs 58 and thus particularly effectively cools the fixed-position spiral component 24. In this respect, the cooling air flow first flows around the fixed-position spiral component 24 and only then around the first housing element 22 or the electronics housing 48. This arrangement is particularly advantageous since the pump-active region of the pump 20 has a high heat development in operation due to the compression and is therefore primarily cooled here.

The pump 20 comprises a pressure sensor 60 integrated into it. Said pressure sensor 60 is arranged within the air guide hood 46 and is screwed into the fixed-position spiral component 24. The pressure sensor 60 is connected to the electronics housing 48 and to a control device arranged therein via a cable connection that is only partly shown. The pressure sensor 60 is integrated into the control of the scroll pump 20 in this respect. For example, the motor 34, which is visible in FIG. 1, can be controlled in dependence on a pressure measured by the pressure sensor 60. For example, when the pump 20 is used in a vacuum system as a roughing pump for a high-vacuum pump, the high-vacuum pump can, for example, only be switched on when the pressure sensor 60 measures a sufficiently low pressure. The high-vacuum pump can thus be protected from damage.

Figure 4:
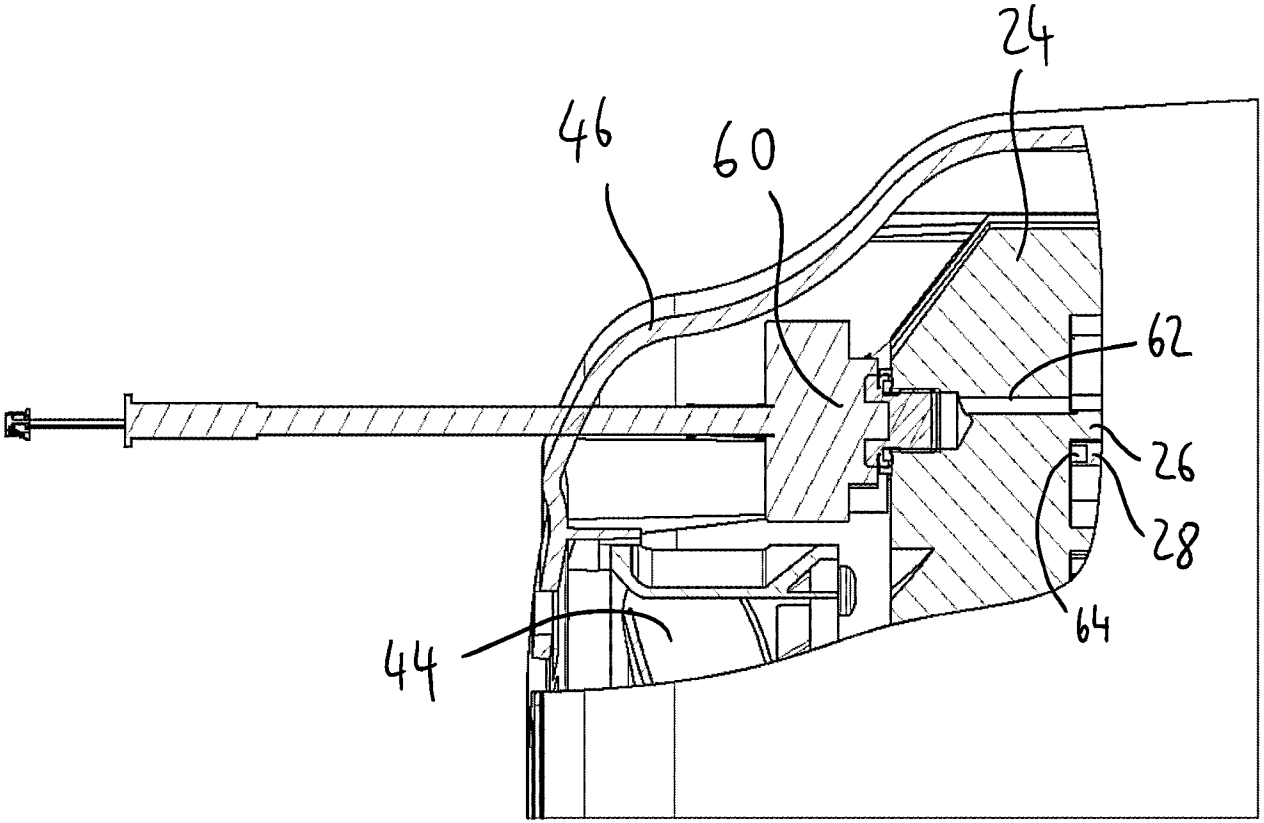
FIG. 4 shows a pressure sensor integrated into the pump.

FIG. 4 shows the pressure sensor 60 and its arrangement at the fixed-position spiral component 24 in a cross-sectional representation. A channel 62 is provided for the pressure sensor 60 and here opens into a non-pump-active outer region between the spiral walls 26 and 28 of the fixed-position or movable spiral components 24 and 30. Thus, the pressure sensor measures a suction pressure of the pump. Alternatively or additionally, a pressure between the spiral walls 26 and 28 in a pump-active region can, for example, also be measured. Depending on the position of the pressure sensor 60 or of the channel 62, intermediate pressures can therefore also be measured, for example.

The pressure sensor 60, for example via the determination of a compression, in particular allows a recognition of a wear state of the pump-active components, in particular of a sealing element 64 that is also designated as a tip seal. Furthermore, the measured suction pressure can also be used for a regulation of the pump (inter alia the pump speed). For example, a suction pressure can thus be predefined at the software side and a suction pressure can be set by varying the pump speed. It is also conceivable that, depending on the measured pressure, a pressure increase caused by wear can be compensated by an increase in the rotational speed. Thus, a tip seal change can be postponed or larger change intervals can be implemented. The data of the pressure sensor 60 can therefore generally e.g. be used for a wear determination, for a situational control of the pump, for a process control, etc.

The pressure sensor 60 can, for example, optionally be provided. Instead of the pressure sensor 60, a blind plug can, for example, be provided to close the channel 62. A pressure sensor 60 can then, for example, be retrofitted if required. Provision can in particular be made with respect to the retrofitting, but also generally advantageously, that the pressure sensor 60 is automatically recognized on the connection to the control device of the pump 20.

The pressure sensor 60 is arranged in the cooling air flow of the fan 44. It is hereby also advantageously cooled. This additionally has the result that no special measures have to be taken for a higher temperature resistance of the pressure sensor 60 and an inexpensive sensor can consequently be used.

In addition, the pressure sensor 60 is in particular arranged such that the outer dimensions of the pump 20 are not increased by it and the pump 20 consequently remains compact.

In FIGS. 5 and 6, the movable spiral component 30 is shown in different views. In FIG. 5, the spiral structure of the spiral wall 28 is particularly easily visible. In addition to the spiral wall 28, the spiral component 30 comprises a base plate 66, starting from which the spiral wall 28 extends.

A side of the base plate 66 remote from the spiral wall 28 is visible in FIG. 6. At this side, the base plate inter alia comprises a plurality of fastening recesses, for instance for fastening the bearing 40 and the corrugated bellows 42 that are visible in FIG. 1.

Three holding projections 68 are provided outside at the base plate 66 that are spaced apart over the periphery of the base plate 66 and that are uniformly distributed over the periphery. The holding projections 68 extend radially outwardly in this respect. The holding projections 68 in particular all have the same radial height.

A first intermediate section 70 of the periphery of the base plate 66 extends between two of the holding projections 68. This first intermediate section 70 has a larger radial height than a second intermediate section 72 and than a third intermediate section 74. The first intermediate section 70 is arranged disposed opposite an outermost 120° section of the spiral wall 28.

On the manufacture of the movable spiral component 30, the base plate 66 and the spiral wall 28 are preferably manufactured together from a solid material in a cutting manner, i.e. the spiral wall 28 and the base plate 66 are formed in one part.

The spiral component 30 can, for example, be directly clamped to the holding projections 68 during a finishing machining. For example, within the framework of one and the same clamping, the side of the base plate 66 shown in FIG. 6 can also be machined and the fastening recesses can in particular be introduced. In general, the chip-forming manufacture of the spiral wall 28 can also take place from the solid material within the framework of this clamping.

Figure 7:
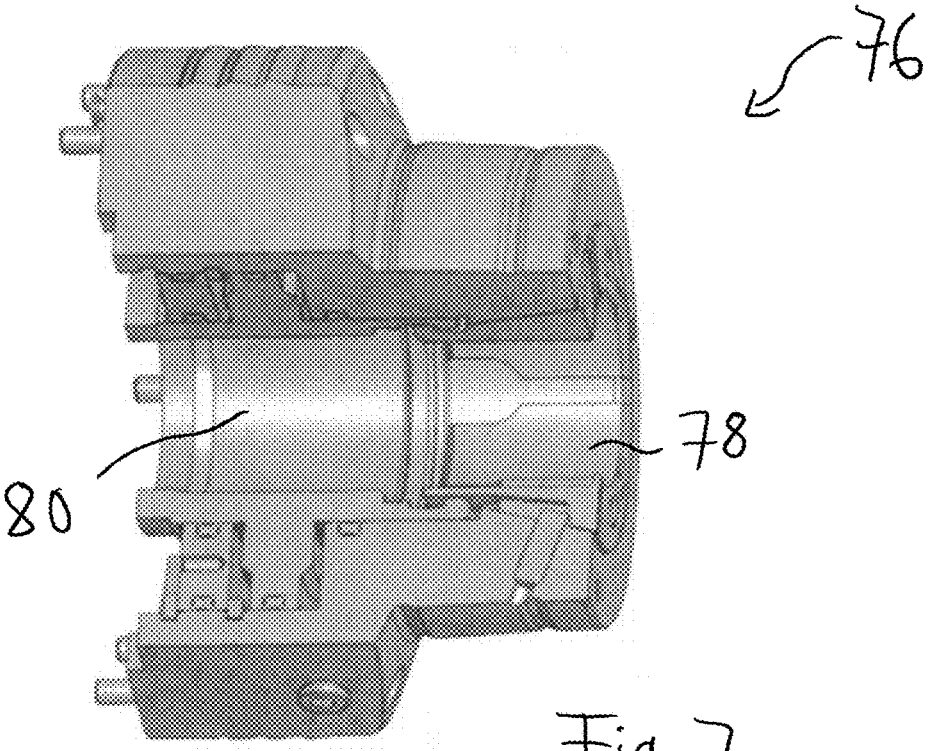
FIG. 7 shows a clamping apparatus for a spiral component.

For this purpose, the spiral component 30 can, for example, be clamped by a clamping apparatus 76 such as is shown in FIG. 7. Said clamping apparatus 76 has a hydraulic three-jaw chuck 78 for direct contact with the three holding projections 68. In addition, the clamping apparatus 76 has a continuous recess 80 through which a tool access to the spiral component 30, in particular to the side thereof that is shown in FIG. 6, is made possible. Machining processes can thus take place from both sides during a clamping, in particular at least one finishing machining of the spiral wall 28 and an introduction of fastening recesses.

The contour of the holding projections 68 and the clamping pressure of the clamping apparatus 76 are preferably selected such that no critical deformations of the spiral component 30 take place. The three holding projections 68 are preferably selected such that the outer dimension, that is the maximum diameter of the spiral component 30, is not increased. Material, on the one hand, and a cutting volume, on the other hand, can thus be saved. The holding projections 68 are in particular designed and/or arranged at such an angular position such that the accessibility of the screw connection of the corrugated bellows 42 is provided. The number of screw connection points of the corrugated bellows 42 is preferably unequal to the number of holding projections 68 at the movable spiral component 30.

Two balance weights 82 are attached to the eccentric shaft 32 of FIG. 1 to compensate an imbalance of the excited system. The region of the balance weight 82 that is at the right side in FIG. 1 is shown in enlarged form in FIG. 8. The balance weight 82 is fixedly screwed to the eccentric shaft 32.

A similar image section is shown in FIG. 9 for another scroll pump that preferably belongs to the same series of the pump 20 of FIG. 1. The pump on which FIG. 9 is based in particular has other dimensions and therefore requires a different balance weight 82.

The eccentric shafts 32, the balance weights 82, and the housing elements 22 are dimensioned such that only one specific kind of the two kinds of balance weights 82 shown can be assembled at the eccentric shaft 32 at the respective fastening position shown.

The balance weights 82 are dimensioned in FIGS. 8 and 9 together with specific dimensions of the construction space provided for them to illustrate that the balance weight 82 of FIG. 9 cannot be assembled at the eccentric shaft 32 and vice versa. It is understood that the specified dimensions are named purely by way of example.

For example, a spacing between a fastening bore 84 and a shaft shoulder 86 amounts to 9.7 mm in FIG. 8. The balance weight 82 of FIG. 8 is shorter in the corresponding direction, namely is 9 mm long, and can therefore be assembled without problem. The balance weight 82 of FIG. 9 has a longitudinal extent of 11 mm measured from the fastening bore in each case. Thus, the balance weight 82 of FIG. 9 cannot be assembled at the eccentric shaft 32 of FIG. 8 since the shaft shoulder 86 collides with the balance weight 82 on an attempted assembly or since the balance weight 82 of FIG. 9 thus cannot be completely brought into contact with the eccentric shaft 82 of FIG. 8. Since the balance weight 82 of FIG. 9 is larger in both measured dimensions than the spacing from the fastening bore 84 and the shaft shoulder 86 in FIG. 8, an assembly in the reverse direction is also prevented. In addition, the dimension of 21.3 mm of the balance weight 82 of FIG. 8 prevents a reversed and consequently incorrect assembly orientation of the otherwise correct balance weight 82.

In FIG. 9, a spacing in the longitudinal direction between the fastening bore 84 and a housing shoulder 88 amounts to 17.5 mm. The balance weight 82 of FIG. 8 with its extent of 21.3 mm would collide with the housing shoulder 88 on the insertion of the eccentric shaft 32 of FIG. 9 so that a complete assembly would not be possible.

The incorrect assembly is indeed first possible, but is reliably recognized. On an assembly of the balance weight 82 of FIG. 8 at the eccentric shaft 32 of FIG. 9 in a manner rotated about the axis of the fastening bore 84, the extent of 21.3 mm would collide with the shaft shoulder 86 that is only arranged at a spacing of 13.7 mm from the fastening bore 84.

The balance weights 82, in particular a motor-side balance weight 82, are generally designed such that a confusion of the balance weight with such other construction sizes is avoided during the assembly and/or the service. The balance weights are preferably fastened by means of passage screws. Similar balance weights of different pump sizes are in particular designed such that an assembly of the incorrect balance weight is prevented due to adjacent shoulders on the shaft and due to the positions of the thread and the passage bore of the balance weight and of shoulders within the housing.

A gas ballast valve 90 of the scroll pump 20 is shown in FIGS. 10 and 11. It is also visible in the overall representation of the pump 20 in FIG. 3 and is arranged at the fixed-position spiral component 24.

The gas ballast valve 90 comprises an actuation grip 92. It comprises a plastic body 94 and a base element 96 that is preferably manufactured from stainless steel. The base element 96 comprises a throughgoing bore 98 that, on the one hand, is provided for the connection and the introduction of a ballast gas and, on the other hand, comprises a check valve 100. In the representations, the bore 98 is additionally closed by means of a plug 102. Instead of the plug 102, a filter can, for example, also be provided, wherein the ballast gas can preferably be air and in particular directly enters into the valve 90 via the filter.

The actuation grip 92 is fastened to a rotatable element 106 of the valve 90 by three fastening screws 104 which are arranged in a respective bore 108 and of which only one is visible in the selected sectional representation of FIG. 11. The rotatable element 106 is rotatably fastened to the second housing element 24 by a fastening screw, not shown, that extends through a bore 110.

To actuate the valve 90, a torque manually applied to the actuation grip 92 is transmitted to the rotatable element 106 and the latter is thus rotated. The bore 98 thus enters into communication with an interior of the housing. Three switching positions are in this respect provided for the valve 90, namely the one shown in FIG. 10, which is a blocking position, and a respective position rotated to the left and to the right, in which positions the bore 98 is in communication with different regions of the interior of the housing.

The bores 108 and 110 are closed by a cover 112. The sealing effect of the gas ballast valve 90 is based on axially pressed O-rings. On an actuation of the valve 90, a relative movement is exerted onto the O-rings. If contaminants, such as particles, reach the surface of an O-ring, this brings along the risk of a premature failure. The cover 112 prevents a penetration of contamination and similar at the screws of the grip 92.

This cover 112 is fastened via an interference fit of three centering elements. Specifically, the cover 112 has an insertion pin, not shown, for each bore 108 by which the cover 112 is held in the bores 108. The bores 108 and 110 and the fastening screws arranged therein are thus protected against contamination. In particular in the case of the fastening screw, not shown, that is arranged in the bore 110 and that enables a rotary movement, a contamination entry into the valve mechanics can be effectively minimized and the service life of the valve can thus be improved.

The plastic grip having an extrusion-coated stainless steel base part ensures a good corrosion resistance with simultaneously low manufacturing costs.

Furthermore, the plastic of the grip remains cooler due to the limited thermal conductivity and can thereby be operated better.

A rotational speed regulation is preferably provided for the fan 44 such as can be seen in FIGS. 1 and 3, for example. The fan is controlled by means of PWM depending on the power consumption and the temperature of the power module that is e.g. accommodated in the electronics housing 48. The rotational speed is set analogously to the power consumption. However, the regulation is only permitted from a module temperature of 50° C. If the pump enters temperature ranges of a possible derating (temperature-induced power reduction), the maximum rotational speed of the fan is automatically controlled. It is made possible by this regulation that a minimum noise level is reached with a cold pump, that a low noise level—corresponding to the pump noise—is present at an end pressure or with a low load, that an ideal cooling of the pump is achieved at a simultaneously low noise level, and that the maximum cooling power is ensured before a temperature-induced power reduction.

The maximum rotational speed of the fan can be adapted, in particular depending on the situation. It can e.g. be expedient for a high water vapor compatibility to reduce the maximum rotational speed of the fan.

In FIG. 12, the movable spiral component 30 is shown in part and enlarged with respect to FIG. 5. A sectional view of the spiral component 30 along the line A:A indicated in FIG. 12 is shown schematically and not to scale in FIG. 13.

At its end remote from the base plate 66 and facing a base plate of the fixed spiral component 24, not shown here, the spiral wall 28 has a groove 114 for the insertion of a sealing element 64 likewise not shown here, namely a so-called tip seal. The arrangement in the operating state is e.g. easily visible in FIG. 4. In accordance with a preferred embodiment of the pump in accordance with the invention, a tip seal is provided that is in grinding contact with the slide layer, i.e. the sealed oxide layer.

The groove 114 is bounded outwardly and inwardly by two oppositely disposed side walls, namely by an inner side wall 116 and by an outer side wall 118. In a first spiral section 120, the outer side wall 118 is thicker than the inner side wall 116 in the first spiral section 120 and thicker than both side walls 116 and 118 in another, second spiral section 122.

The first spiral section 120 extends from the location indicated in FIG. 12 up to the outer end of the spiral wall 28 as is also indicated in FIG. 5, for example. The first spiral section 120 here by way of example extends over approximately 163°.

The first spiral section 120 forms an outer end section of the spiral wall 28. In this respect, the first spiral section 120 is at least partly arranged, and in particular completely arranged, in a non-pump-active region of the spiral wall 28. The first spiral section 120 can in particular at least substantially completely fill the non-pump-active region of the spiral wall 28.

As can be seen in FIG. 5, the first intermediate section 70 between two holding projections 68 that has a larger radial height than other intermediate sections 72 and 74 can preferably be arranged disposed opposite the first spiral section 120. An imbalance introduced by the thicker side wall 118 can thus be compensated by the larger weight of the first intermediate section 70.

For a low system load on the bearings and other components, the movable spiral component should generally preferably have a small inherent weight. Therefore, the spiral walls are generally very thin. Furthermore, smaller pump dimensions (significant outer diameter) result with thinner walls. The side walls of the tip seal groove are consequently particularly thin. The ratio of the tip seal wall thickness to the total spiral wall thickness e.g. amounts to at most 0.17. However, due to the tip seal groove, the spiral wall tip is very sensitive with respect to shocks during the handling, such as during the assembly or during the change of the tip seal. The side wall of the groove can be pressed inwardly by slight impacts, e.g. also during the transport, so that the tip seal can no longer be assembled. To satisfy this problem, the groove comprises an asymmetrical wall thickness, in particular an outwardly local thickening of the spiral wall. This region is preferably not pump-active and can therefore be produced with a larger tolerance. Damage is considerably reduced by the one-sided thickening at the winding, in particular at the last half of the winding. A thickening of the spiral wall is preferably not necessary at other positions of the component since the wall is protected by projecting elements of the component.

The air guide hood 46 shown in FIG. 1 defines an air flow such as is indicated by a dotted arrow 124. The fan 44 is connected to a control device in the electronics housing 48 via a cable, not shown, extending through the air guide hood 46 and via a plug-in connection. Said plug-in connection comprises a socket 126 and a plug 128. The socket 126 is supported at the electronics housing 48 and/or is fastened to a circuit board arranged in the electronics housing 48. The socket 126 is, for example, also visible in FIGS. 2 and 3. The plug 128 is connected to the fan 44 via the cable, not shown.

The plug-in connection 126, 128 is separated from the air flow 124 by a partition wall 130. The air flow 124 that can, for example, include dust or similar contamination is thus kept away from the plug-in connection 126, 128. On the one hand, the plug-in connection 126, 128 itself is thus protected and, on the other hand, the contaminants are prevented from entering the electronics housing 48 through the opening provided for the socket 126 and from reaching the control device and/or the power electronics.

The air guide hood 46 is shown separately and perspectively in FIG. 14. Among other things, the partition wall 130 is visible with the space that is defined behind it and that is provided for the plug 128. The partition wall 130 comprises a recess 132, designed as a V-shaped notch here, for the leading through of a cable from the plug 128 to the fan 44.

Inexpensive plug connectors without a sealing (e.g. no IP protection) can e.g. be used to save costs since the partition wall 130 ensures that the sucked-in air does not reach the electronics via the opening of the plug connector 126, 128. The cable of the fan is laterally led through the partition wall 130 through the V-shaped notch 132. The notch 132 has a lateral offset from the plug connector 126, 128, whereby a labyrinth effect and thus a further reduction of the leakage of cooling air to the plug connector 126, 128 can be achieved. The air flow into the channel 50 between the electronics housing 48 and the pump housing 22 is additionally improved by a partition wall 130 within the air guide hood 46. Less turbulence and counter-pressure thus arise for the fan 44.

FIG. 15 shows a contact region between the first housing element 22 and the second housing element or a fixed-position spiral component 24 in a schematic sectional representation. The second housing element 24 is partly inserted into the first housing element 22 with a transition fit 134. A sealing by means of an O-ring 136 is provided in this respect. The transition fit 134, for example, also serves for the centering of the second housing element 24 with respect to the first housing element 22.

The second housing element 24, for example, has to be dismantled for maintenance purposes, for example for replacing the sealing element 64. In this respect, it can occur that the transition fit 134 or the O-ring 136 jams if the second housing element 24 is not pulled out straight enough. A forcing-off thread 138 is provided to solve this problem. A second forcing-off thread can preferably also be provided in an at least substantially radially oppositely disposed manner. To release the second housing element 24 in as straight and guided a manner as possible, a screw can be screwed into the forcing-off thread 38 until the screw projects from it and comes into contact with the first housing element 22. Due to a further screwing in, the housing elements 22 and 24 are pushed away from one another.

The fastening screws 142, as they are, for example, designated in FIGS. 1 and 3, provided for fastening the second housing element 24 to the first housing element 22 can, for example, be used for the forcing off. For this purpose, the forcing-off thread 138 preferably has the same kind of thread as fastening threads provided for the fastening screws 142.

A depression 140 that is associated with the forcing-off thread 138 is provided at the second housing element 22. If abrasion particles are carried off on a screwing of the screw into the forcing-off thread 138, they collect in the depression 140. It is thus prevented that such abrasion particles, for example, prevent a complete contact of the housing elements 22 and 24 with one another.

The screws have to be unscrewed again on the assembly of the fixed-position spiral component 24 since otherwise a complete screwing (correct seat on the planar surface of the housing) of the fixed-position spiral component 24 to the first housing element 22 is prevented where possible. Leakage, misalignment and a reduction of the pump performance can be the result. To avoid this assembly error, the air guide hood 46 has at least one dome 144, in particular an additional dome 144, that is shown in FIG. 14 and that only enables an assembly of the air guide hood 46 when the screws used for the forcing off, in particular the fastening screws 142, have been removed again. This is because the air guide hood 46 with the dome 144 is configured such that it would collide with a screw head of a forcing-off screw possibly screwed into the forcing-off thread 138 so that the air guide hood 46 could not be completely assembled. The air guide hood 46 can in particular only be assembled when the forcing-off screws are completely dismantled.

FIG. 16 schematically shows a detailed representation of the spiral pump or scroll pump 20 in accordance with the previous Figures in the region where the seal 150 contacts the carrier 154, in the form of the base plate 66, provided with the slide layer 152, i.e. the sealed oxide layer. The arrangement of the spiral elements 26, 28 in particular takes place such that the seal 150 is pressed against the carrier 154, in the form of the base plate 66. The pressing of the seal against the base plate takes place via the pressure difference between the two sides of the spiral elements 26, 28. The seal 150 is connected via a boundary surface 151 to the spiral elements 26, 28. The oxide layer and the sealing of the slide layer 152 are not shown separately since the sealing has entered into and closes the pores and defects of the oxide layer. An additional layer buildup does not necessarily take place. The sealing, which is preferably fluorine-free, not only promotes the dry lubricating properties of the slide layer 152 and additionally reduces its wear, but also improves the gas tightness of the slide layer 152, whereby an improvement of the achievable end pressures and a reduction of the run-in time result.

The carriers 154, in the form of the base plate 66, and the spiral walls 26, 28 are each formed in one piece and are composed of an aluminum alloy of the AlMgSi type. The oxide layer of the slide layer 152 is an aluminum oxide layer produced by anodic oxidation in a sulfuric acid electrolyte. The slide layer 152 is in particular applied to all the surfaces of the spiral components 24, 30 facing the pumping spaces. The seal 150 (tip seals) shown in FIG. 6 is an acrylate-based fluorine-free polymer, for example.

The pump in accordance with the invention can have individual features or a plurality of the features described above with reference to FIGS. 1 to 16, wherein any desired combinations of these features can be implemented in a pump in accordance with the invention.

In FIG. 17, an electron-microscopic image of a cross-section is shown that shows an oxide layer 156 having a thickness of 39.08 μm that is applied to a base plate 66. The scale in FIG. 17 shows a length of 10 μm. The oxide layer 156 has cracks 158 and defects 158 that impair the gas tightness. An even further enlarged view is shown in FIG. 18 in which the pore structure and the defects that connect the pores can be recognized. The scale in FIG. 18 shows a length of 200 nm. The porous structure of the oxide layer 156 can also be seen from FIG. 19 that shows an electron-microscopic view of the oxide layer of FIG. 17 and FIG. 18, wherein the pores 160 appear as dark, vertically extending stripes and very small defects 158 can also be recognized as dark spots that connect adjacent pores 160 to one another. The scale in FIG. 18 shows a length of 200 nm. Very small pores 160 and also larger pores 160 as well as cracks 158 and their branchings can be recognized. In FIGS. 17 to 19, in each case only a few pores and defects are marked with reference numerals.

The effect of the slide layer of the pump in accordance with the invention can be recognized based on the graph shown in FIG. 20. The time is plotted in hours on the abscissa axis (X axis); the pressure is plotted in hPa on the ordinate axis. In each case, under identical conditions, a negative pressure was generated by scroll vacuum pumps, wherein the development of the respective negative pressure was recorded over time.

With all the lines A to D, a pump of the HiScroll type was used in each case, said lines A to D only differing in that, at line A, the conveying elements do not have a coating. At line B, the conveying elements have a coating as described in EP 3 153 706 A1, wherein a sulfuric acid electrolyte, i.e. an anodically produced oxide layer, was used to produce the oxide layer. Line C shows the development of the vacuum with a sealed slide layer based on a fluorine-containing polymer, as described in EP 3 940 234 A2. Line D shows the development of the vacuum with a vacuum pump in accordance with the invention in which the oxide layer is additionally provided with a fluorine-free polymer-based sealing on an acrylate basis. The sealing of the oxide layer of line D was produced as described by means of the following example.

As can be seen from line A, a low end pressure can indeed be achieved very quickly with uncoated conveying elements, but it is not stable due to the wear of the conveying elements. An end pressure that is stable, but relatively high even after a long run-in phase can be achieved if the conveying elements have an anodic coating. This becomes clear with reference to line B. With the pump of line B, the test was interrupted after a short running time and a sealing was applied to the oxide layer. When the test is continued, it is noticeable that the pressure drops much faster and a significantly lower end pressure is reached. Line C shows that a lower end pressure can indeed be achieved with the fluorine-containing sealing known from the prior art, but there is still the need for a certain run-in phase and the disadvantage of relying on fluorine-containing components that may not be ideal for environmental reasons due to their durability in nature. The sealed conveying elements, as were used for line D, i.e. in a pump in accordance with the invention, enable a much lower end pressure than for line B (until the interruption of the test), wherein the vacuum achieved is stable unlike for line A. For lines B and C, a significantly longer run-in time is to be expected until the lower end pressures are reached. With the sealing in accordance with the invention, not only does an excellent achievable end pressure thus tend to be reached, but the run-in time is also significantly reduced. This illustrates the remarkable effects that are achieved due to the sealing of the pore structure of the oxide layer with respect to short run-in times, low end pressures, and high corrosion and wear resistances.

However, the pump in accordance with the invention can also be a turbomolecular pump as is generally described in FIGS. 21 to 25.

The turbomolecular pump 111 shown in FIG. 21 comprises a pump inlet 115 which is surrounded by an inlet flange 113 and to which a recipient, not shown, can be connected in a manner known per se. The gas from the recipient can be sucked out of the recipient via the pump inlet 115 and can be conveyed through the pump to a pump outlet 117 to which a backing pump, such as a rotary vane pump, can be connected.

In the alignment of the vacuum pump in accordance with FIG. 21, the inlet flange 113 forms the upper end of the housing 119 of the vacuum pump 111. The housing 119 comprises a lower part 121 at which an electronics housing 123 is laterally arranged. Electrical and/or electronic components of the vacuum pump 111 are accommodated in the electronics housing 123, e.g. to operate an electric motor 125 (cf. also FIG. 23) arranged in the vacuum pump. A plurality of connectors 127 for accessories are provided at the electronics housing 123. Furthermore, a data interface 129, e.g. in accordance with the RS485 standard, and a power supply connector 131 are arranged at the electronics housing 123.

Turbomolecular pumps also exist that do not have such an attached electronics housing, but are connected to external drive electronics.

A flood inlet 133, in particular in the form of a flood valve, via which the vacuum pump 111 can be flooded, is provided at the housing 119 of the turbomolecular pump 111. In the region of the lower part 121, a barrier gas connector 135 is furthermore arranged which is also called a purge gas connector and via which purge gas can be let into the motor space 137, in which the electric motor 125 is accommodated in the vacuum pump 111, to protect the electric motor 125 (see e.g. FIG. 23) from the gas conveyed by the pump. Furthermore, two coolant connectors 139 are also arranged in the lower part 121, with one of the coolant connectors being provided as an inlet and the other coolant connector being provided as an outlet for coolant that can be conducted into the vacuum pump for cooling purposes. Other existing turbomolecular vacuum pumps (not shown) are operated with air cooling only.

The lower side 141 of the vacuum pump can serve as a standing surface so that the vacuum pump 111 can be operated standing up at the lower side 141. The vacuum pump 111 can, however, also be fastened to a recipient via the inlet flange 113 and can thus so-to-say be operated in a suspended manner. Furthermore, the vacuum pump 111 can be designed such that it can also be put into operation when it is aligned in a different manner than shown in FIG. 21. Embodiments of the vacuum pump can also be implemented in which the lower side 141 can be arranged not directed downwardly, but rather facing to the side or directed upwardly. Any desired angles are generally possible in this respect.

Other existing turbomolecular vacuum pumps (not shown), which are in particular larger than the pump shown here, cannot be operated standing up.

Various screws 143 by means of which components of the vacuum pump that are not further specified here are fastened to one another are arranged at the lower side 141 that is shown in FIG. 22. A bearing cap 145 is, for example, fastened to the lower side 141.

Furthermore, fastening bores 147 via which the pump 111 can, for example, be fastened to a support surface are arranged at the lower side 141. This is not possible with other existing turbomolecular vacuum pumps (not shown) that are in particular larger than the pump shown here.

A coolant line 148 is shown in FIGS. 22 to 25 in which the coolant led in and out via the coolant connectors 139 can circulate.

As the cross-sectional representations of FIGS. 23 to 25 show, the vacuum pump comprises a plurality of process gas pump stages for conveying the process gas present at the pump inlet 115 to the pump outlet 117.

A rotor 149 is arranged in the housing 119 and has a rotor shaft 153 rotatable about an axis of rotation 151.

The turbomolecular pump 111 comprises a plurality of turbomolecular pump stages connected to one another in series in a pump-active manner and having a plurality of radial rotor disks 155 fastened to the rotor shaft 153 and a plurality of stator disks 157 arranged between the rotor disks 155 and fixed in the housing 119. A rotor disk 155 and an adjacent stator disk 157 each form one turbomolecular pump stage in this respect. The stator disks 157 are held by spacer rings 159 at a desired axial spacing from one another.

The vacuum pump furthermore comprises Holweck pump stages arranged in one another in a radial direction and connected to one another in series in a pump-active manner. Other turbomolecular vacuum pumps (not shown) exist that do not have Holweck pump stages.

The rotor of the Holweck pump stages comprises a rotor hub 161 arranged at the rotor shaft 153 and two Holweck rotor sleeves 163, 165 of cylinder jacket shape that are fastened to the rotor hub 161 and supported by it, that are oriented coaxially to the axis of rotation 151, and that are nested in one another in the radial direction. Furthermore, two Holweck stator sleeves 167, 169 of cylinder jacket shape are provided that are likewise oriented coaxially to the axis of rotation 151 and that are nested in one another in the radial direction.

The pump-active surfaces of the Holweck pump stages are formed by the jacket surfaces, that is by the radial inner surfaces and/or outer surfaces, of the Holweck rotor sleeves 163, 165 and of the Holweck stator sleeves 167, 169. The radial inner surface of the outer Holweck stator sleeve 167 is disposed opposite the radial outer surface of the outer Holweck rotor sleeve 163, while forming a radial Holweck gap 171, and forms the first Holweck pump stage following the turbomolecular pumps with it. The radial inner surface of the outer Holweck rotor sleeve 163 is disposed opposite the radial outer surface of the inner Holweck stator sleeve 169, while forming a radial Holweck gap 173, and forms a second Holweck pump stage with it. The radial inner surface of the inner Holweck stator sleeve 169 is disposed opposite the radial outer surface of the inner Holweck rotor sleeve 165, while forming a radial Holweck gap 175, and forms the third Holweck pump stage with it.

A radially extending passage via which the radially outwardly disposed Holweck gap 171 is connected to the middle Holweck gap 173 can be provided at the lower end of the Holweck rotor sleeve 163. Furthermore, a radially extending passage via which the middle Holweck gap 173 is connected to the radially inwardly disposed Holweck gap 175 can be provided at the upper end of the inner Holweck stator sleeve 169. The Holweck pump stages nested in one another are thereby connected to one another in series. A connection passage 179 to the outlet 117 can furthermore be provided at the lower end of the radially inwardly disposed Holweck rotor sleeve 165.

The above-named pump-active surfaces of the Holweck stator sleeves 167, 169 each have a plurality of Holweck grooves extending in the axial direction spirally about the axis of rotation 151 while the oppositely disposed jacket surfaces of the Holweck rotor sleeves 163, 165 are smooth and advance the gas for operating the vacuum pump 111 into the Holweck grooves.

For the rotatable support of the rotor shaft 15, a rolling element bearing 181 is provided in the region of the pump outlet 117 and a permanent magnet bearing 183 is provided in the region of the pump inlet 115.

In the region of the rolling element bearing 181, a conical splash nut 185 having an outer diameter increasing toward the rolling element bearing 181 is provided at the rotor shaft 153. The splash nut 185 is in sliding contact with at least one wiper of an operating medium store. In other existing turbomolecular vacuum pumps (not shown), an injection screw may be provided instead of a splash nut. Since different designs are thus possible, the term "spray tip" is also used in this connection.

The operating medium store comprises a plurality of absorbent disks 187 that are stacked on one another and that are saturated with an operating medium for the rolling element bearing 181, e.g. with a lubricant.

In the operation of the vacuum pump 111, the operating medium is transferred by capillary action from the operating medium store via the wiper to the rotating splash nut 185 and is conveyed as a consequence of the centrifugal force along the splash nut 185 in the direction of the outer diameter of the splash nut 185, which becomes larger, to the rolling element bearing 181, where it e.g. satisfies a lubricating function. The rolling element bearing 181 and the operating medium store are encompassed by a tub-shaped insert 189 and the bearing cap 145 in the vacuum pump.

The permanent magnet bearing 183 comprises a rotor-side bearing half 191 and a stator-side bearing half 193 which each comprise a ring stack of a plurality of permanent magnetic rings 195, 197 stacked on one another in the axial direction. The ring magnets 195, 197 are disposed opposite one another while forming a radial bearing gap 199, with the rotor-side ring magnets 195 being arranged radially outwardly and the stator-side ring magnets 197 being arranged radially inwardly. The magnetic field present in the bearing gap 199 effects magnetic repulsion forces between the ring magnets 195, 197 that effect a radial support of the rotor shaft 153. The rotor-side ring magnets 195 are carried by a carrier section 201 of the rotor shaft 153 that surrounds the ring magnets 195 at the radial outer side. The stator-side ring magnets 197 are carried by a stator-side carrier section 203 that extends through the ring magnets 197 and that is suspended at radial struts 205 of the housing 119. The rotor-side ring magnets 195 are fixed in parallel with the axis of rotation 151 by a cover element 207 coupled to the carrier section 201. The stator-side ring magnets 197 are fixed in parallel with the axis of rotation 151 in the one direction by a fastening ring 209 connected to the carrier section 203 and by a fastening ring 211 connected to the carrier section 203. A plate spring 213 can additionally be provided between the fastening ring 211 and the ring magnets 197.

An emergency bearing or safety bearing 215 is provided within the magnetic bearing; it idles in the normal operation of the vacuum pump 111 without contact and only moves into engagement on an excessive radial deflection of the rotor 149 relative to the stator to form a radial abutment for the rotor 149 so that a collision of the rotor-side structures with the stator-side structures is prevented. The safety bearing 215 is configured as a non-lubricated rolling element bearing and forms a radial gap with the rotor 149 and/or the stator, said radial gap having the effect that the safety bearing 215 is out of engagement in normal pump operation. The radial deflection during which the safety bearing 215 enters into engagement is dimensioned sufficiently large that the safety bearing 215 does not move into engagement in the normal operation of the vacuum pump and is simultaneously small enough that a collision of the rotor-side structures with the stator-side structures is avoided under all circumstances.

The vacuum pump 111 comprises the electric motor 125 for a rotating driving of the rotor 149. The armature of the electric motor 125 is formed by the rotor 149 whose rotor shaft 153 extends through the motor stator 217. A permanent magnet arrangement can be arranged at the radial outer side or in an embedded manner on the section of the rotor shaft 153 extending through the motor stator 217. An intermediate space 219 that comprises a radial motor gap, via which the motor stator 217 and the permanent magnet arrangement 128 can have a magnetic effect for transferring the drive torque, is arranged between the motor stator 217 and the section of the rotor 149 extending through the motor stator 217.

The motor stator 217 is fixed in the housing within the motor space 137 provided for the electric motor 125. A barrier gas that is also called a purge gas and that can be air or nitrogen can reach the motor space 137 via the barrier gas connector 135. The electric motor 125 can be protected from process gas, e.g. from corrosively active portions of the process gas, via the barrier gas. The motor space 137 can also be evacuated via the pump outlet 117, i.e. the vacuum pressure effected by the backing pump connected to the pump outlet 117 is at least approximately present in the motor space 137.

Furthermore, a so-called labyrinth seal 223 that is known per se can be provided between the rotor hub 161 and a wall 221 bounding the motor space 137, in particular to achieve a better sealing of the motor space 217 with respect to the Holweck pump stages disposed radially outside.

The sealing of a porous oxide layer will be described by way of example in the following. It is understood that the following description merely serves for illustration and does not limit the invention in any way.

A pump-active component of a scroll vacuum pump composed of an aluminum alloy (EN AW-6082) was first anodized to create an oxide layer on the surface of this component. A sulfuric acid electrolyte at a bath temperature of 5° C. and a current density of 4 A/dm$^2$ were used for the anodization.

Subsequently, i.e. without intermediate drying, the component was exposed to a negative pressure in a vacuum cell to remove residues and impurities from the pores of the oxide layer. The component was then treated, under applied vacuum, with an aqueous sodium acrylate solution of 10% by weight. Naturally, the vacuum is in this respect selected so that the sodium acrylate solution does not boil. The sodium acrylate is present as an ionogenic dispersion in the aqueous solution. During the treatment with the sodium acrylate solution, the component is poled as the anode, wherein a DC voltage of 60 V and a current density of 2 A/dm$^2$ are applied. The treatment duration in the present example was 5 minutes. Due to the current density (directed flow), the acrylate (particles)/ions in the pore are discharged/deposited/precipitated and thus close the pores of the oxide layer produced by the anodization.

The sodium acrylate solution was then removed and the component was temperature-treated at 100 to 180° C. This results in a polymerization of the acrylate, whereby the pores are permanently closed.

In the exemplary method of manufacturing the sealed surface, a film thickness of <1 μm is formed on the surface. Depending on the duration and current intensity, significantly thicker films can also be achieved, i.e. up to 5 μm can be achieved. Conversely, a very low film thickness can also be achieved, i.e. the polymerization of the acrylate essentially takes place within the pores. The film thickness refers to an additional application by the sealing to the porous surface that was previously formed by anodizing.

REFERENCE NUMERAL LIST

For FIGS. 1 to 16

20 scroll pump

22 first housing element

24 second housing element/fixed-position spiral component
26 spiral wall
28 spiral wall
30 movable spiral component
32 eccentric shaft
34 motor
36 rolling element bearing
38 eccentric pin
40 rolling element bearing
42 corrugated bellows
44 fan
46 air guide hood
48 electronics housing
50 channel
52 chamber
54 rib
56 recess
58 rib
60 pressure sensor
62 channel
64 sealing element
66 base plate
68 holding projection
70 first intermediate section
72 second intermediate section
74 third intermediate section
76 clamping apparatus
78 three-jaw chuck
80 recess
82 balance weight
84 fastening bore
86 shaft shoulder
88 housing shoulder
90 gas ballast valve
92 actuation grip
94 plastic body
96 base element
98 bore
100 check valve
102 plug
104 fastening screw
106 rotatable element
108 bore
110 bore
112 cover
114 groove
116 inner side wall
118 outer side wall
120 first spiral section
122 second spiral section
124 air flow
126 socket
128 plug
130 partition wall
132 recess
134 transition fit
136 O-ring
138 forcing-off thread
140 depression
142 fastening screw
144 dome
150 seal
152 slide layer
154 carrier For FIGS. 21 to 25:

111 turbomolecular pump
113 inlet flange
115 pump inlet
117 pump outlet
119 housing
121 lower part
123 electronics housing
125 electric motor
127 accessory connector
129 data interface
131 power supply connector
133 flood inlet
135 barrier gas connector
137 motor space
139 coolant connector
141 lower side
143 screw
145 bearing cap
147 fastening bore
148 coolant line
149 rotor
151 axis of rotation
153 rotor shaft
155 rotor disk
157 stator disk
159 spacer ring
161 rotor hub
163 Holweck rotor sleeve
165 Holweck rotor sleeve
167 Holweck stator sleeve
169 Holweck stator sleeve
171 Holweck gap
173 Holweck gap
175 Holweck gap
179 connection passage
181 rolling element bearing
183 permanent magnet bearing
185 splash nut
187 disk
189 insert
191 rotor-side bearing half
193 stator-side bearing half
195 ring magnet
197 ring magnet
199 bearing gap
201 carrier section
203 carrier section
205 radial strut
207 cover element
209 support ring
211 fastening ring
213 plate spring
215 emergency bearing or safety bearing
217 motor stator
219 intermediate space
221 wall
223 labyrinth seal

The invention claimed is:

1. A method of coating a pump-active component of a pump, comprising the following steps:

Step A) providing the pump-active component composed of a light metal workpiece and having a porous oxide layer on a surface, Step B) exposing the pump-active component to a negative pressure, Step C) contacting the porous oxide layer with a solution comprising at least one polymerizable sealing precursor and/or at least one sol-gel-based sealing precursor, wherein a voltage is applied to the pump-active part during at least one of the steps A) to C).

2. The method in accordance with claim 1, wherein the polymerizable precursor is fluorine-free.

3. The method in accordance with claim 1, wherein, in step C), the solution includes ions and/or ionic compounds.

4. The method in accordance with claim 1, wherein at least one compound having functional groups from the families of the organic anions, and/or from the family of inorganic ions is included in the solution of step C).

5. The method in accordance with claim 4, wherein the families of the organic anions comprise substituted acrylates and/or substituted acetates and/or substituted styrenes and/or substituted isocyanates and/or carboxyls and/or sulfonic acid.

6. The method in accordance with claim 4, wherein the family of inorganic ions comprise silicates and aluminates.

7. The method in accordance with claim 1, wherein the voltage is successively increased during the treatment of the pump-active component.

8. The method in accordance with claim 1, wherein the voltage is between 50 and 300 V.

9. The method in accordance with claim 1, wherein the voltage is applied to the pump-active component using a direct current.

10. The method in accordance with claim 1, wherein the pump-active component is heat-treated after completion of the electrochemical treatment.

11. The method in accordance with claim 10, wherein the heat treatment step is carried out at 100° C. to 300° C.

12. The method in accordance with claim 1, wherein the sealing precursor is precipitated in the pores during the electrochemical treatment.

13. The method in accordance with wherein the sealing precursor is polymerized in the pore of the porous oxide layer.

14. A pump comprising a pump-active component, the pump active component having been formed in by a method comprising the following steps:

Step A) providing the pump-active component composed of a light metal workpiece and having a porous oxide layer on a surface, Step B) exposing the pump-active component to a negative pressure, Step C) contacting the porous oxide layer with a solution comprising at least one polymerizable sealing precursor and/or at least one sol-gel-based sealing precursor, wherein a voltage is applied to the pump-active part during at least one of the steps A) to C).

15. The pump in accordance with claim 14, wherein the pump comprises a pump-active component having a coating, wherein the coating comprises an oxide layer, the oxide layer having pores, and a fluorine-free polymer-based and/or sol-gel-based sealing, and wherein the pores of the oxide layer are at least partly covered by the sealing and/or impregnated with the sealing and/or filled with the sealing.

16. The pump in accordance with claim 14, wherein the oxide layer is formed by anodic oxidation in an acidic electrolyte.

17. The pump in accordance with claim 14, wherein it is a spiral pump or scroll pump, comprising conveying elements formed as spiral elements, wherein the sealing is at least regionally applied to at least one of the conveying elements formed as spiral elements.

18. The pump in accordance with claim 17, wherein it is a spiral vacuum pump or a scroll vacuum pump.

19. The pump in accordance with claim 14, wherein it is a piston pump, comprising at least one cylinder, which has an inner cylinder wall, and a piston movable in the cylinder, wherein the sealing is at least regionally applied to the inner cylinder wall and/or the piston.

20. The pump in accordance with claim 19, wherein it is a piston vacuum pump.

21. The pump in accordance with claim 14, wherein it is a turbomolecular pump, wherein the sealing is at least regionally applied to rotor disks and/or stator disks.

* * * * *